United States Patent [19]

Hayashi et al.

[11] 3,948,377

[45] Apr. 6, 1976

[54] COIN HANDLING APPARATUS FOR A VENDING MACHINE

[75] Inventors: Yukichi Hayashi; Yutaka Yokoda, both of Tokyo; Masayuki Tamura, Sakado; Shinichi Kobayashi, Kamihukuoka; Kazuyuki Akai, Tokyo; Seiu Sakai, Yamato, all of Japan

[73] Assignee: Nippon Coinco Co., Ltd., Tokyo, Japan

[22] Filed: Oct. 29, 1974

[21] Appl. No.: 518,460

Related U.S. Application Data

[62] Division of Ser. No. 432,977, Jan. 14, 1974, Pat. No. 3,896,915.

[30] Foreign Application Priority Data

| | | |
|---|---|---|
| Jan. 17, 1973 | Japan | 48-7549 |
| Feb. 13, 1973 | Japan | 48-17721 |
| July 24, 1973 | Japan | 48-83328 |
| July 24, 1973 | Japan | 48-83329 |
| July 27, 1973 | Japan | 48-84684 |
| Aug. 22, 1973 | Japan | 48-94078 |
| Aug. 22, 1973 | Japan | 48-94079 |
| Aug. 23, 1973 | Japan | 48-98931[U] |

[52] U.S. Cl.... 194/1 C; 194/DIG. 14; 194/DIG. 15; 133/2

[51] Int. Cl.[2] ..... G07F 9/00

[58] Field of Search ..... 194/1 E, 1 K, DIG. 14, 194/DIG. 15 C, 1 C, 1 D; 133/2, 3 R

[56] References Cited

UNITED STATES PATENTS

| | | | |
|---|---|---|---|
| 2,179,091 | 11/1939 | Hoyt | 133/3 R |
| 2,433,689 | 12/1947 | Fry | 194/DIG. 15 C |
| 2,567,900 | 9/1951 | Winkler | 133/2 |
| 2,571,596 | 10/1951 | Meredith | 194/DIG. 14 |

*Primary Examiner*—Stanley H. Tollberg
*Assistant Examiner*—H. Grant Skaggs

[57] ABSTRACT

A vending machine adapted to temporarily retain a coin of large denomination which is not usable as a change coin among the deposited coins and store coins of small denominations in coin stacking tubes. When the deposited money is to be returned, coins of the same denominations as the deposited small denomination coins are paid out from the coin stacking tubes while the retained large denomination coin itself is also returned. In event the vending machine is short of change coins, the vending machine vends the required article only when a coin requiring no change is deposited and automatically returns the deposited coin when a coin requiring change is deposited.

1 Claim, 21 Drawing Figures

CG1
CG2
CGn
VE1
VE2
VEn
CA
TE
S4
S6
S8
S7
S1
S2
S3
FS
FD
DP
RG
AS
OR
AN
CM1
CMA1
CMA2
CM2
CMAn
CMn
SS1
SS2
SSn
SP1
SP2
SPn
AP1
AP2
AP5
A1
A2
An
Ad1
Ad2
Adn
PC
T1
T2
T3
T4
T5
T6
T7
T8
T9
T10
E1
E2
Rc
WP
P1
P5

COIN HANDLING APPARATUS FOR A VENDING MACHINE

This is a division of application Ser. No. 432,977, filed Jan. 14, 1974, and now U.S. Pat. No. 3,896,915.

BACKGROUND OF THE INVENTION

This invention relates to a vending machine and, more particularly, to a vending machine capable of accurately returning a coin of the same denomination as that inserted in the vending machine in case the coin has once been inserted in the machine but should be returned because purchase of the goods is not made for one reason or another, and also capable of paying out change either in large denomination coins or in small denomination coins according to necessity and returning the inserted coin when the machine is short of a required change.

In vending machines of known types, returning of money equivalent in sum to an inserted coin for cases where purchase of the goods has not been made is achieved by using coins stored in a change coin stacking tube. If an amount of money equivalent to an inserted large denomination coin such as 100 yen is to be returned but the coin of the same denomination is not stored as change in the change coin stacking tube, small denomination coins such as 10 yen or 50 yen must be used. This causes shortage of change and if the shortage of change is to be avoided, the vending machine requires a large change coin stacking tube.

The prior art vending machine is also disadvantageous in that a return instruction tends to be given before the amount of the inserted coin is electrically calculated in case a return button is depressed immediately after the coin is inserted in the machine with a result that shortage or even absence of refund occurs.

In order to avoid shortage of change, another conventional type of vending machine employs a construction such that an inserted coin is temporarily retained and thereafter is transferred to a cash box when purchase is made or returned when it is to be refunded. This type of vending machine, however, requires a large and complicated mechanism for retaining all of the inserted coins. Besides, the retained coins cannot be used as change in this type of vending machine.

There is still another type of prior art vending machine which temporarily retains all inserted coins by the kind of coin and thereafter returns them when they are to be refunded and transfer them to change stacking tube when purchase is made. This type of vending machine also requires a complicated coin retaining mechanism and, moreover, has a defect that coins become jammed in a chute of the machine with a resulting faulty operation of the machine since a relatively large number of coins are transferred simultaneously from the coin retaining unit to the change stacking tubes.

It is, therefore, an object of the invention to provide a novel and useful vending machine which has eliminated the above described disadvantages of the prior art vending machines.

It is another object of the invention to provide a vending machine capable of counting and storing the amount and kind (denomination) of inserted coins and temporarily retaining a large denomination coin or coins among the inserted coins while storing small denomination coins in a change coin stacking tube provided for each denomination of coin so as to enable the machine to return the retained large denomination coin itself as well as return the same denomination of coins as the inserted small denomination coins from the change coin stacking tube. Each time the coin is returned, the amount of the coin is subtracted from the whole amount of the inserted coins and the coin return operation is finished when the balance becomes zero.

It is another object of the invention to provide a vending machine incorporating a control system which produces a vend signal regardless of the amount of stored change when an inserted coin requires no change and, when the inserted coin requires change, returns a coin of the same denomination as the inserted coin only in case the machine is short of change.

It is another object of the invention to provide a vending machine incorporating a control system which actuates a coin return mechanism when the amount of inserted coin or coins coincide with a set vend price or when a return button is depressed so as to return coins inserted in the machine thereafter. According to the inventive vending machine, a subtraction, change payment or return order is given with a delay of a predetermined period of time after a vend order signal or a return signal is received so as to ensure accurate detection, vend and return operations of the machine and thereby to eliminate an erroneous operation of the machine.

It is another object of the invention to provide a vending machine capable of vending a plurality of pieces of one and the same commodity with a single coin depositing action.

It is another object of the invention to provide a vending machine capable of selectively vending a plurality of different kinds of commodities.

It is another object of the invention to provide a vending machine in which adverse effects of noise is effectively prevented and an erroneous operation of the machine at the time of turning-on of power is completely eliminated.

It is anaother object of the invention to provide a vending machine which has eliminated likelihood of miscounting which occurs at the time when different denominations of coins are simultaneously detected by detection switches.

It is still another object of the invention to provide a vending machine incorporating an escrow device which temporarily retains a large denomination coin sorted out by a coin acceptor and not used as change among inserted coins, such retention of the coin being effected by return and receiving levers capable of projecting into entrances to a coin path leading to a return outlet and a path leading to a cash box, and thereafter leads the retained coin to the return path by withdrawing the return lever when the coin is to be returned and to the cash box by withdrawing the receiving lever when purchase is made.

Other objects and features of the invention will become apparent from the description made hereinbelow with reference to the accompanying drawings in which:

FIG. 10 (*b*) is a side elevational view showing relative positions of the coin paths in the neighbourhood of an outlet of an acceptor A in section;

Figure 16A:
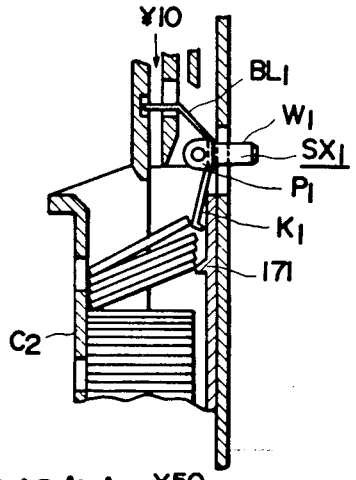
Figure 16B:
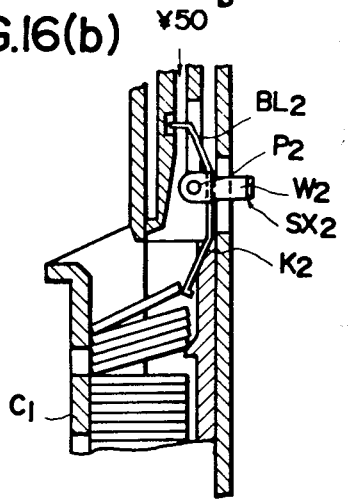
Figure 17:
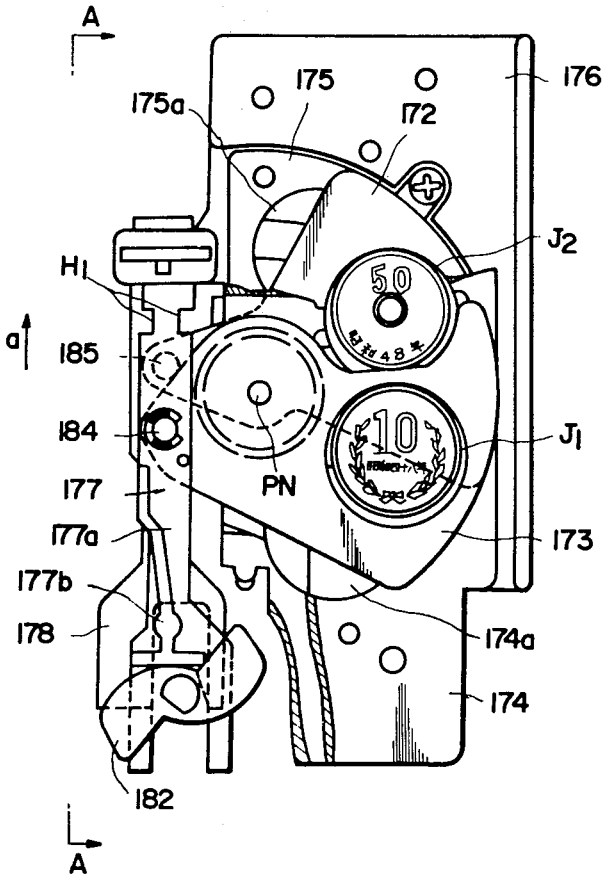
Figure 18:
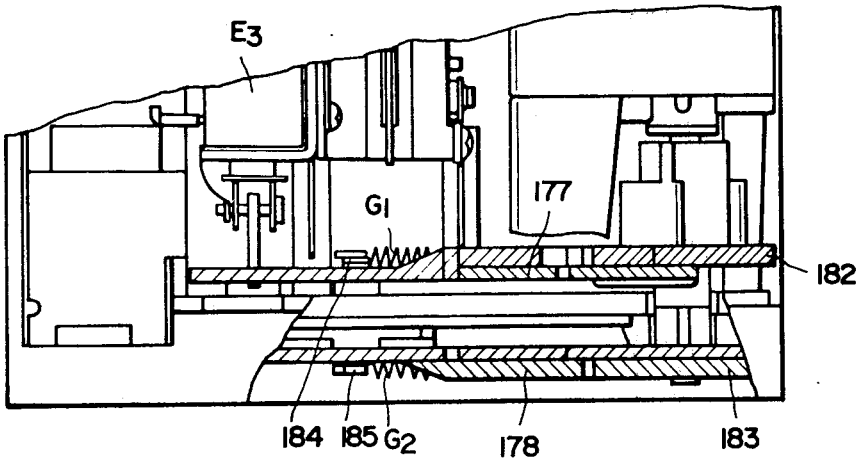
Figure 19:
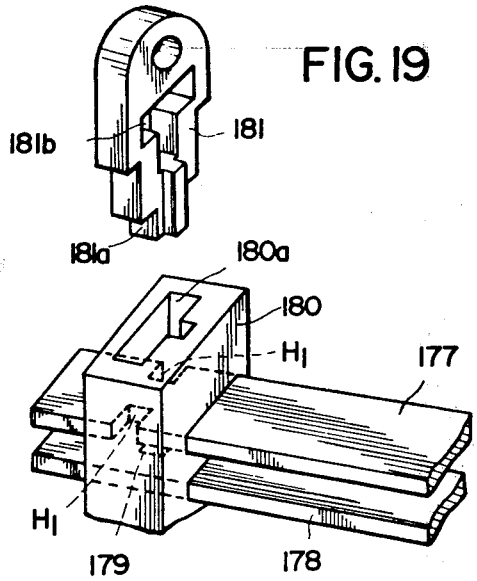

FIGS. 16 (*a*) and (*b*) are side elevational views showing upper portions of the 10 yen and 50 yen coin tubes in section for explaining operations for receiving and rejecting the coins;

FIG. 17 is a top plan view of a change payout device;

FIG. 18 is a view of the change payout device taken along line A—A of FIG. 17; and FIG. 19 is a perspective view illustrative of interlocking relations between a link lock, a 10 yen payout link and a 50 yen payout link.

Figure 1:
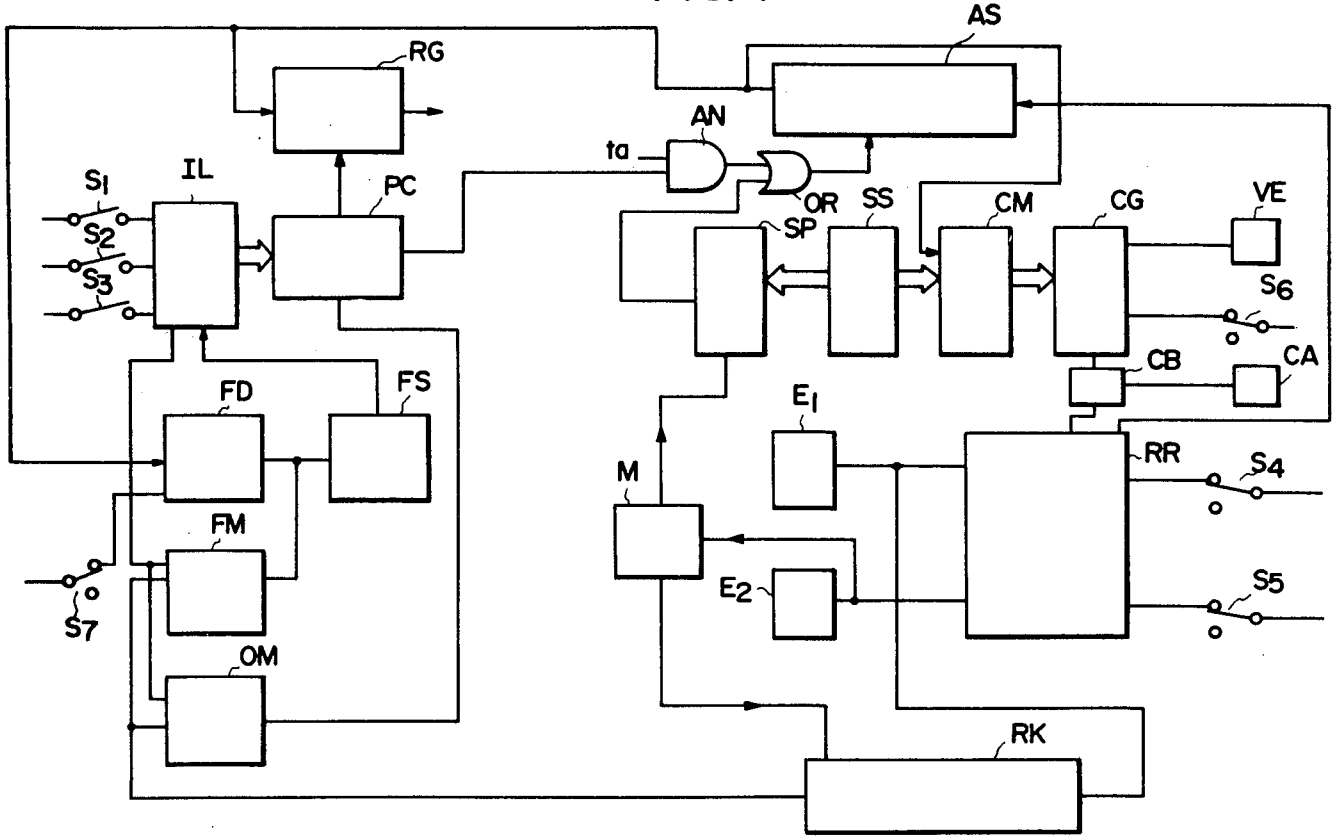
FIG. 1 is a block diagram schematically showing one preferred embodiment of the vending machine according to the invention.
Figure 10:
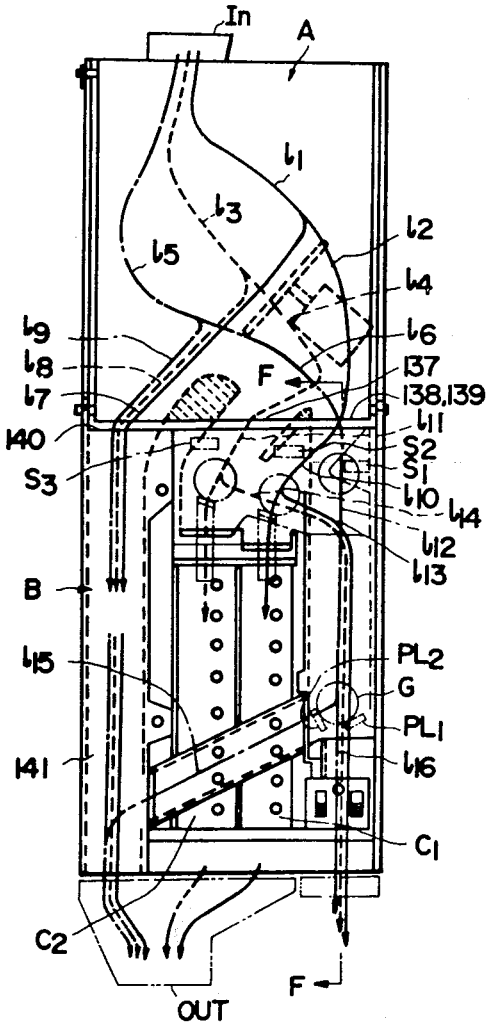
FIG. 10 (*a*) is a front elevational view showing coin paths of a coin control device of the inventive vending machine.
Figure 10B:
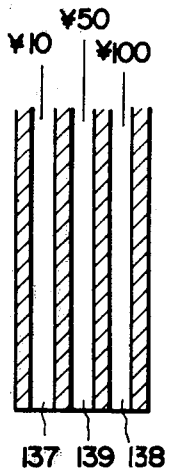

Referring first to FIG. 1, reference characters $S_1$, $S_2$ and $S_3$ respectively designate switches for detecting insertion of 100 yen, 50 yen and 10 yen coins. The 100 yen coin among the inserted coins is temporarily retained in mechanical manner since this coin is not used as change. This mechanism for retaining the 100 yen coin is shown in FIG. 10. Referring to FIG. 10, if a coin return electromagnetic control device to be described later is not in operation, a 50 yen coin inserted from an insertion slot In passes through paths $l_1$ and $l_2$, actuates the switch $S_2$ and thereafter is received in a 50 yen change coin stacking tube $C_1$. A 10 yen coin likewise passes through paths $l_3$ and $l_4$, actuates the switch $S_3$ and thereafter is received in a 10 yen change coin stacking tube $C_2$. A 100 yen coin passes through paths $l_5$ and $l_6$, actuates the switch $S_1$ and thereafter is temporarily retained in a mechanical manner by means of a plunger $PL_1$ of a return solenoid $E_1$ and a plunger $PL_2$ of a receiving solenoid $E_2$.

Reverting to FIG. 1, IL designates an input logic circuit, PC a pulse control section which produces a pulse of a predetermined pulse width upon receipt of a signal from the input logic circuit PC, an AND gate, an OR gate, and AS an addition and subtraction counter which adds or subtracts by the output pulses supplied from the OR gate OR. SS designates a vend price setting circuit, CM a comparison circuit for comparing the output of the addition and subtraction counter AS with the output of the vend price setting circuit SS and produces a coincidence signal when these outputs coincide with each other, CG a vend signal storage and control section for storing and controlling a vend signal by means of the coincidence signal supplied from the comparison circuit CM, VE a vend signal transmitter, CA a coin return solenoid, CB a control circuit for energizing the solenoid CA when the amount of the inserted coins has reached a predetermined vend price or when a return instruction is received, $S_4$ a return swtich, $S_5$ a vend switch, RR a return and receiving control section for actuating the return solenoid $E_1$ or the receiving solenoid $E_2$ upon closing of the switch $S_4$ or $S_5$, RK a change payout and return section, FD a 50 yen detection section for detecting whether a required change is 50 yen or more or less than 50 yen, FM a 50 yen coin memory for storing the number of 50 yen coins among the coins inserted in the machine, $S_7$ a switch for detecting whether there is a 50 yen coin in a 50 yen change coin stacking tube $C_1$, OM a 100 yen coin memory for storing the number of 100 yen coins among the coins inserted in the machine, FS a 50 yen – 10 yen supply electromagnetic control section for supplying a 50 yen coin when energized, and 10 yen coin when deenergized, during the change payout or coin returning operation, RG a reset signal generating circuit which produces a reset signal when the count of the addition and subtraction counter has become "0", $S_6$ a switch for detecting whether there is a 10 yen coin in a 10 yen change coin stacking tube $C_2$, and M a subtraction instruction control section respectively.

The control system of the vending machine according to the invention will be described in detail with reference to the circuit diagram shown in FIG. 2.

Reference characters $S_1$, $S_2$ and $S_3$ designate switches which respectively are actuated by passing coins sorted out by a coin acceptor (hereinafter referred to as "acceptor") A for detecting the insertion of the coin. In the illustrated embodiment, the switch $S_1$ is adapted to detect a 100 yen coin, the switch $S_2$ a 50 yen coin and the switch $S_3$, a 10 yen coin respectively. The switches $S_1$, $S_2$ and $S_3$ are connected to the pulse control section PC through corresponding inverters 1, 2 and 3 and chattering prevention circuits 4, 5 and 6. The switches $S_1$, $S_2$ and $S_3$ are applying high level signals to the inputs of the respective inverters 1, 2 and 3 in the state shown in the figure. When the switches $S_1$, $S_2$ and $S_3$ are actuated upon detection of the coins, low level signals are applied to the inputs of these inverters 1, 2 and 3. In the following description, a high level is represented by "1" and a low level by "0".

Figure 4:
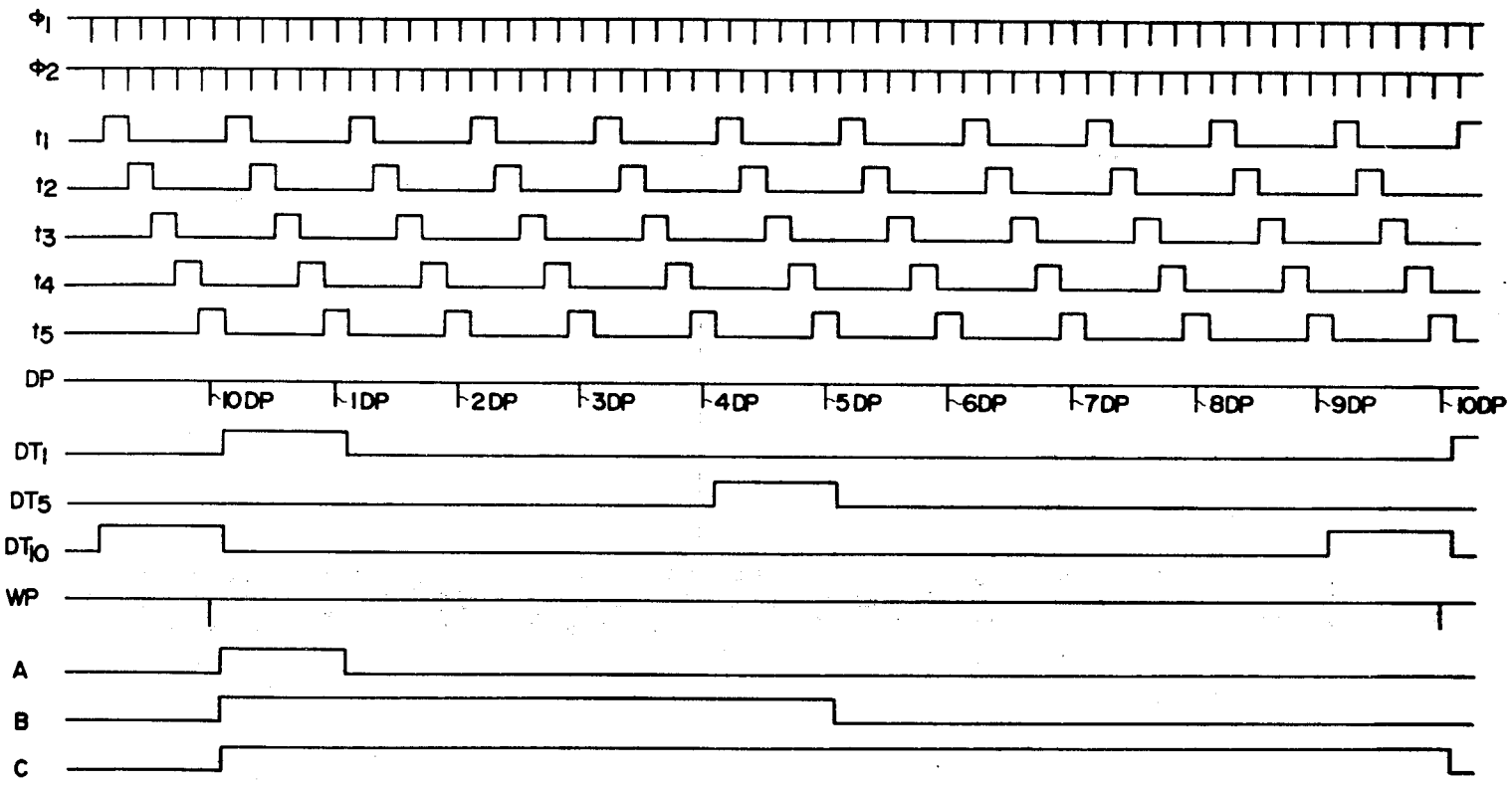
FIG. 4 is a time chart illustrative of signals appearing at various parts in the circuit shown in FIG. 2.

The pulse control section PC is adapted to produce pulses of predetermined different pulse widths in response to coin detection signals supplied from the switches $S_1$, $S_2$ and $S_3$. When the switch $S_3$ is actuated upon insertion of a 10 yen coin to apply a signal "1" to a terminal $T_3$ of the pulse control section PC, the pulse control section PC produces a pulse of a pulse width shown as A in FIG. 4. When the switch $S_2$ is actuated upon insertion of a 50 yen coin to apply a signal "1" to a terminal $T_2$, the pulse control section PC produces a pulse of a pulse width shown as B in FIG. 4. (This pulse width is five times as long as the pulse width of the pulse A.) Similarly, a pulse of a pulse width shown as C in FIG. 4 is produced upon detection of a 100 yen coin.

Figure 3:
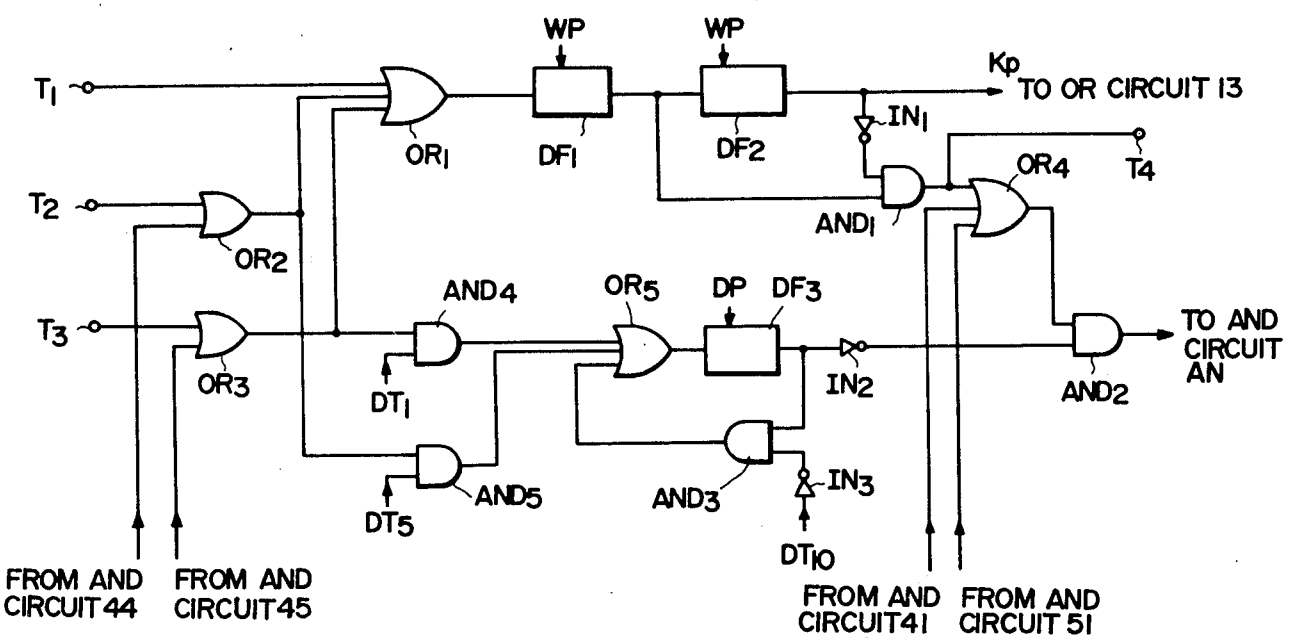
FIG. 3 is a detailed circuit diagram of a pulse control section PC shown in FIG. 1.

One prefersed example of circuit construction of such pulse control section PC is illustrated in FIG. 3. The construction and operation of this pulse control section will now be described.

An OR gate $OR_1$ receives a coin detection signal supplied from the terminals $T_1$ and coin detection signals supplied from the terminals $T_2$ and $T_3$ via OR gates $OR_2$ and $OR_3$. When a signal "1" which represents detection of a coin is applied to either one of the terminals $T_1 - T_3$, the OR circuit $OR_1$ produces a signal "1" which is applied to the input terminal of a flip-flop $DF_1$. The flip-flop $DF_1$ receives a working pulse WP such as shown in FIG. 4. The flip-flop $DF_1$ stores and outputs the signal "1" upon receipt of a first working pulse WP (the 1st word) and thereafter resets this output signal "1" upon receipt of a next working pulse WP (the second word) if a signal applied at this time to the input terminal thereof is "0". The output of the flip-flop $DF_1$ is applied to one of the input terminals of an AND gate $AND_1$ and also to the input of a flip-flop $DF_2$. The flip-flop $DF_2$ is of the same construction as the flip-flop $DF_1$. The output of this flip-flop $DF_2$ which is still "0" at the first word and becomes "1" at the second word is applied to the other inpuut of the AND gate $AND_1$ through an inverter $IN_1$. Accordingly, the input signals of the AND gate $AND_1$ at the first word are both "1" so that the AND gate $AND_1$ produces a signal "1" during a period of time between the generation of the first working pulse WP and the generation of the next working pulse WP (hereinafter referred to as "1 word time"). This output signal "1" representing the fact that a coin of either denomination has been inserted in the machine is fed to an AND gate $AND_2$ via an OR gate $OR_4$. This output signal "1" of the AND gate $AND_1$ has a pulse width which is entirely the same as the one shown as C in FIG.. 4.

The AND gate $AND_2$ also receives output of an inverter $IN_2$. This output of the inverter $IN_2$ is "0" only when a signal "1" is applied either from the OR gate $OR_2$ to an AND gate $AND_5$ or from the OR gate $OR_3$ to an AND gate $AND_4$ to cause the AND gate $AND_5$ or $AND_4$ to gate out the signal "1". Accordingly, when the 100 yen coin detection switch $S_1$ is actuated to apply a signal "1" to the terminal $T_1$, the output of the inverter $IN_2$ is "1" and the AND gate $AND_2$ gates out the output signal "1" from the AND gate $AND_1$. Since the output of the AND circuit $AND_2$ represents the output of the pulse control section PC, a pulse signal having a pulse width of 1 word time shown as C in FIG. 4 is produced from the pulse control section PC upon detection of insertion of a 100 yen coin.

When the 50 yen coin detection switch $S_2$ is actuated to apply a signal "1" to the terminal $T_2$, the signal "1" is applied fromt the OR gate $OR_2$ to one of the input terminals of the AND gate $AND_5$. In the meanwhile, a pulse $DT_5$ as shown in FIG. 4 is successively applied to the other input terminal of the AND gate $AND_5$. Accordingly, the AND gate $AND_5$ produces a pulse signal having a pulse width which is the same as the one of the pulse $DT_5$ when the two signals are simultaneously applied to the inputs of the AND gate $AND_5$. This signal "1" is applied to the input of a flip-flop $DF_3$ through an OR circuit $OR_5$. The flip-flop $DF_3$ constantly receives a pulse DP as shown in FIG. 4 which has a period of one-tenth that of the working pulse WP. The flip-flop $DF_3$ stores and outputs the signal "1" of the OR circuit $OR_5$ upon receipt of a first pulse DP and resets the signal "1" upon receipt of a next pulse DP. Accordingly, the output of the flip-flop $DF_3$ is "1" while the pulse DP is between 5 DP and 6 DP. This signal "1" is applied to the inverter $IN_2$ and one of the input terminals of an AND gate $AND_3$. A pulse $DT_{10}$ as shown in FIG. 4 is successively applied to the other input of the AND gate $AND_3$ through an inverter $IN_3$. Since the pulse $DT_{10}$ is not generated at the pulse 5 DP, the AND gate $AND_3$ produces an output signal "1". This output signal "1" is applied to the flip-flop $DF_3$ via the OR gate $OR_5$. Accordingly, the output signal "1" of the flip-flop $DF_3$ is self-held after the pulse 6 DP. This self-holding is released when the pulse $DT_{10}$ is applied to the inverter $IN_3$. Thus, the output of the inverter $IN_3$ becomes "O" substantially after the pulse 5 DP. The AND condition of the AND gate $AND_2$ is satisfied only during a period of time between the generation of the pulse C shown in FIG. 4 from the AND gate $AND_1$ and the substantial generation of the pulse 5 DP, and the pulse control section PC produces a pulse signal shown as B in FIG. 4 during this time.

When the 10 yen coin detection switch $S_3$ is actuated to apply a signal "1" at the terminal $T_3$, this signal "1" is applied to one of the inputs of an AND gate $AND_4$ through the OR gate $OR_3$. Since a pulse $DT_1$ as shown in FIG. 4 is applied to the other input of the AND gate $AND_4$, the AND gate $AND_4$ produces a pulse having the same pulse width as the pulse $DT_1$ when it receives the two input signals simultaneously. This output pulse of the AND gate $AND_4$ is applied to the input of the $DF_3$ through the OR gate $OR_5$. For the reason described above, the output of the flip-flop $DF_3$ becomes "1" substantially after the pulse 1 DP and, accordingly, the output of the inverter $IN_2$ becomes "0". The AND condition of the AND gate $AND_2$ therefore is satisfied only during a period of time between the generation of the pulse shown as C in FIG. 4 from the AND gate $AND_1$ and the substantial generation of the pulse 1 DP, and the pulse control section PC produces a pulse signal shown as A in FIG. 4 which represents the detection of the insertion of the 10 yen coin.

As will be described in detail later, pulse signals corresponding to the denominations of the inserted coins are also produced from the pulse control section PC when the coins are to be returned. In this case, signals are applied from AND gates 41, 44, 45 and 51 to be described later to the OR gates $OR_2$, $OR_3$ and $OR_4$ of the pulse control section PC. The output of the flip-flop $DF_2$ is applied to an OR gate $OR_{13}$ as a signal KP as will also be described later. Further, the output of the AND gate $AND_1$ is applied to the terminal $T_4$ in addition to the OR gate $OR_4$.

Reverting to FIG. 2, construction and operation of the circuit stages post to the pulse control section PC will be described. The output pulse from the pulse control section PC is applied to the AND gate AN. The AND gate AN also receives a pulse $t_1$ as shown in FIG. 4. The AND gate AN gates out only one shot of the pulse $t_1$ upon receipt of the pulse A (FIG. 4) from the pulse control section PC, i.e. upon detection of the insertion of a 10 yen coin. This pulse $t_1$ is applied to the addition and subtraction counter AS through the OR gate OR. Similarly, five shots of the pulse $t_1$ pass through the AND gate AND and applied to the addition and subtraction counter AS through the OR circuit OR upon detection of a 50 yen coin. When the insertion of a 100 yen coin has been detected, 10 shots of the pulse $t_1$ are applied to the addition and subtraction counter AS through the AND gate AN and the OR gate OR.

If a 100 yen coin or a 50 yen coin is inserted, one shot of the pulse C shown in FIG. 4 is produced from a terminal $T_4$. If the inserted coin is a 100 yen coin, an AND gate 58 receives the signal from the terminal $T_1$ and the signal from the terminal $T_4$. The AND gate 58 therefore produces an output representing the insertion of one 100 yen coin and this output is stored in a 100 yen coin memory 52. If the inserted coin is a 50 yen coin, an AND gate 53 receives the signal from the terminal $T_2$ and the signal from the terminal $T_4$ and produces an output representing the insertion of one 50 yen coin. This output is stored in a 50 yen memory 54.

From the foregoing description, it will be understood that pulses corresponding in number to the quotient obtained by dividing the whole amount of the inserted coins by 10 yen are applied to the input of the addition and subtraction counter AS.

The addition and subtraction counter AS receives an addition and subtraction control input from an inverter 7. The addition and subtraction counter AS performs addition when the control input is "0", and performs subtraction when the control input is "1". The addition and subtraction counter AS is of a conventional construction including a shift register and a binary counter.

When a coin is inserted in the machine, the control input to the addition and subtraction counter AS is "0" as will be described later and, in this case, the addition and subtraction counter AS performs addition. As all of the coins have been inserted, a value corresponding to the total amount of the inserted coins is counted in the form of a binary information in the addition and subtraction counter AS. The respective stages of the shift register of the addition and subtraction counter AS provide the comparison circuit CM with outputs $P_1$, $P_2$ . . . $P_5$. The comparison circuit CM has at the input side thereof a plurality of exclusive OR circuits which receive these outputs $P_1$, $P_2$, . . . $P_5$ at one of their inputs. The other input terminals of the exclusive OR circuits are connected to the vend price setting circuit SS. The vend price setting circuit SS is capable of setting a vend price at a desired price and supplying binary signals corresponding to the set vend price to the exclusive OR circuits of the comparison circuit CM. The outputs of the exclusive OR circuits are connected to the input of an AND gate CMA. Accordingly, the comparison circuit CM produces an output "1" when the count of the addition and subtraction counter AS coincides with the set vend price.

This output is stored in a memory 8 and also applied to one of the inputs of an AND gate 10 through an OR gate 9. Since at this time the AND gate 10 receives at the other input an output from the memory 8, the AND gate 10 produces an output which is applied to one of the inputs of an AND gate 12 through a flip-flop 11. As will be described later, a signal "1" is constantly applied to the other input of the AND gate 12, so that the AND gate 12 produces an output "1" which causes the vend signal transmitter VE to transmit a vend signal.

The output signal of the memory 8 is applied also to the coin return solenoid CA. This return solenoid CA is provided for moving a pin into and out of the coin path of an acceptor A. When a signal "1" is applied to the solenoid CA, the solenoid CA is deenergized to project the pin into the coin path of the acceptor A. Accordingly, a coin which has fallen in the coin path is blocked by the pin and returned to a return outlet OUT. If, for example, a purchaser has inserted a 100 yen coin against a set price of 60 yen and thereafter has erroneously inserted a 10 yen coin, this 10 yen coin is automatically returned.

When a purchaser depresses a purchase button (not shown) after the vend signal is output from the vend signal transmitter VE, a predetermined article for sale is delivered and the vend switch $S_4$ is simultaneously actuated. As the switch $S_4$ is changed over from the state shown in FIG. 2, an input to an inverter 14 becomes "0" and the inverter 14 produces an output "1". This output "1" is applied to a memory 15 and stored therein. The output of the memory 15 is applied to a timer T*a* through an OR gate 16 to start a delaying action of the timer T*a*. The timer T*a* outputs a signal "0" when it is not in operation. This signal "0" is inverted by an inverter $I_{17}$ and the inverted output "1" is reinverted by the inverter $I_7$ to become a signal "0". This signal "0" is applied to the addition and subtraction counter AS to cause it to perform its counting operation. After the delaying operation, the timer T*a* produces an output signal "1" which is inverted by the inverter $I_{17}$ and reinverted by the inverter $I_7$. Accordingly, a signal "1" is applied to the addition and subtraction counter AS to make it ready for subtracting operating. In the meanwhile, the output "0" of the inverter 17 is applied to an AND gate 19. Since the AND condition of the AND gate 19 is not satisfied, the output of the AND gate 19 becomes "0" and, accordingly, the output of the AND gate 12 becomes "0", thereby stopping the operation of the vend signal transmitter VE. Thus, the vend signal transmitter VE ceases to produce the vend signal.

The output "0" of the inverter 17 is inverted by an inverter 18 and the inverted output "1" is applied to a times $T_6$ and also to one of the inputs of each of AND gates 20 and 21. The timer $T_6$ produces a signal "1" after lapse of a predetermined period of time and this signal "1" is applied to another input terminal of each of the AND gates 20 and 21. The AND condition of the AND gate 20 is not satisfied at the time when the signal "1" is produced from the inverter 18 because the output of the memory 15 is being applied to another input terminal of the AND gate 20 through an inverter 23. On the other hand, the output "1" of the memory 15 is applied to another input terminal of the AND gate 21. The AND gate 21 therefore produces an output "1" which is applied to the receiving solenoid $E_2$ to actuate it. As the receiving solenoid $E_2$ is actuated, the pin $PL_2$ provided on the cash box side in a device for mechanically retaining a coin temporarily is withdrawn and the coin which has been temporarily retained is received in the cash box.

The output "1" of the AND gate 21 is applied to a flip-flop 26 via an OR gate 25 and stored therein. The flip-flop 26 produces an output upon receipt of the pulse DP. This output of the flip-flop 26 is returned to the flip-flop 26 via the AND gate 27 and the OR gate 25 to maintain the flip-flop 26 in a self-holding state. The output "1" of the flip-flop 26 is also applied to a flip-flop 28. The output terminal of the flip-flop 28 is connected through an inverter 29 to one of the input terminals of an AND gate 30. While the flip-flop 26 outputs "1" and the flip-flop 28 has not received the DP pulse yet, all of the inputs of the AND gate 30 are "1" so that the AND gate 30 produces an output "1". The output "1" of the AND gate 30 is fed to AND gates $SP_1$ – $SP_5$ of the subtraction pulse transmitter SP.

Accordingly, the vend price setting circuit SS produces outputs upon receipt of the timing pulses $t_1$ – $t_5$ thereby subtracting a value corresponding to the vend price from the count of the register of the addition and subtraction counter AS. If the vend price and the amount of the inserted coin coincide with each other, all of the outputs $P_1 - P_5$ of the respective stages of the register of the addition and subtraction counter AS become "0" and the whole circuit is reset. For this purpose, a reset circuit RG is provided. The reset circuit RG receives the signal $P_1 - P_5$ and produces a signal Rc when all the input signals $P_1 - P_5$ are "0". This reset signal Rc is applied to each of the memories and AND gates of the circuit.

Thus, the count of the addition and subtraction counter AS becomes a difference obtained by subtracting the set vend price from the amount of the inserted coin. If this value is not zero, a sum corresponding to this value should be paid out as change.

The change payout operation will now be described taking by way of example a case where the price is 120 yen and two 100 yen coins have been deposited.

Figure 2:
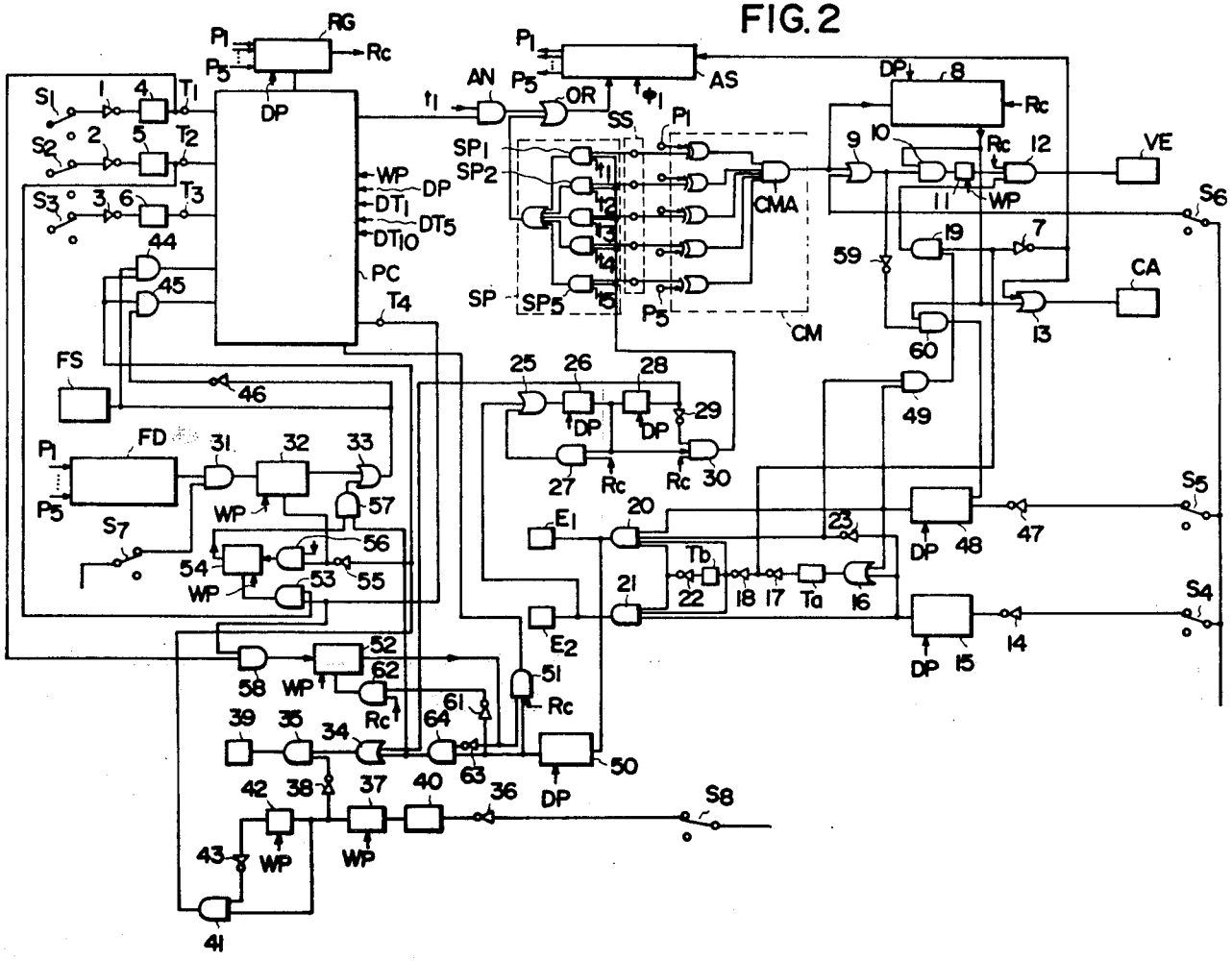
FIG. 2 is a detailed circuit diagram of the embodiment shown in FIG. 1.

Referring to FIG. 2, the count of the addition and subtraction counter AS becomes 80 after depression of the vend switch $S_4$. A detector FD detects whether the change to be returned is 50 yen and over or not. The detector FD is adapted to receive the outputs $P_1 - P_5$ of the addition and subtraction counter AS and produce an output "1" when its count is 5 or more (i.e. when the change is 50 yen or more), and "0" when its count is 1, 2, 3 or 4 (i.e. when the change is less than 50 yen). The output of the detector FD is applied to one of the inputs of an AND gate 31. The other input of the AND gate 31 is connected to a switch $S_7$ provided for detecting whether the 50 yen coin tube is empty or not. Accordingly, the AND gate receives a signal "1" when there is a 50 yen coin in the 50 yen coin tube and passes a signal " 1" to a memory 32 when the change is 50 yen or more. The signal "1" stored in the memory 32 energizes the electromagnetic control section FS through an OR gate 33. In the meanwhile, the output signal "1" of the flip-flop 28 is applied to one of the inputs of an AND gate 35 via an OR gate 34. Since the output of an inverter 36 is "0" and the output of a flip-flop 37 is "0" when a change payout switch $S_8$ is in the state shown in FIG. 2, an output "1" of an inverter 38 is applied to one of the AND gate 35. The AND gate 35 thereupon produces an output "1" which is applied to a motor control section 39 to actuate it for driving the motor. As one 50 yen coin has been delivered as a part of the required change, the switch $S_8$ is changed to a position in which the output of the inverter 36 is changed to "1". This output "1" is applied to one of the inputs of an AND gate 41 through a chattering prevention circuit 40 and a flip-flop circuit 37. Snce a flip-flop 42 produces an output "0" until it receives a pulse WP, an output "1" of an inverter 43 is applied to the other input of the AND gate 41. The AND gate therefore produces an output "1" which is applied to one of the inputs of each of AND gates 44 and 45. Since at this time the AND gates 44 and 45 recive the output "1" of the OR gate 33 at the other input thereof, this AND gate 44 produces an output "1". This output is applied to the pulse control section PC producing the same result as if a 50 yen coin was inserted in the machine. Accordingly, the pulse control section PC provides the AND gate AN with a signal B shown in FIG. 4 and five pulses are applied to the addition and subtraction counter AS via the OR gate OR. Since the addition and subtraction counter AS is in a subtraction mode at this time, the counter AS effects subtraction to reduce its count to 3.

This causes the output of the detector FD to change to "0" thereby deenergizing the electromagnetic control section FS. In other words, the change payout mechanism is brought into a 10 yen payout mode. Thus, one 10 yen coin is delivered at each rotation of the change payout motor in the same manner as has previously been described, whereas the output "1" of the AND gate 41 is applied to one of the inputs of the AND gate 45.

The output "0" of the OR circuit 33 is inverted by an inverter 46 and the output "1" of the inverter 46 is applied to the other input of the AND gate 45. The AND gate 45 therefore produces an output "1" which is applied to the pulse control section PC producing the same result as if a 10 yen coin was inserted in the machine. The pulse control section PC provides the AND gate AN with a signal A shown in FIG. 4. Accordingly, one pulse is applied to the addition and subtraction counter AS via the OR gate OR to reduce the count of the counter AS to 2. Ten yen coins are subsequently delivered in the same manner until the whole circuit stops its operation upon receipt of a reset signal Rc which is produced when the count of the addition and subtraction counter AS has become 0. Thus, the change payout operation has been completed.

Next to be described is an operation of the machine in a case where the purchaser has pressed a return button after inserting a coin in the machine.

When the return button (not shown) is depressed and the return switch $S_5$ is thereby changed over, an inverter 47 produces an output "1" which is sorted in a return signal memory 48. The output "1" of this memory 48 is applied to one of the inputs of a NAND circuit 49. Since a signal "1" is applied to the other input of the NAND circuit 49 at this time, the NAND circuit produces an output "0". The AND conditions of the AND gates 19 and 12 are no longer satisfied so that the vend signal is interrupted. Simultaneously, the output "1" of the return signal memory 48 is applied to the AND gate 20 to satisfy the AND condition thereof in a state in which the vend switch $S_4$ is not in operation. Accordingly, the output "1" of the AND gate 20 is applied to the return solenoid $E_1$.

As the signal "1" is applied to the return solenoid $E_1$, the return pin $PL_1$ of the previously described temporary retaining device is withdrawn and the temporarily retained coin is returned to a return outlet OUT.

Assume now that one 10 yen coin, one 50 yen coin and one 100 yen coin have been inserted. In this case, the temporarily retained 100 yen coin is returned in the above described manner, whereas the 10 yen and 50 yen coins in the total amount of 60 yen are returned in the same manner as in the change payout. More specifically, the output "1" of the AND gate 20 is applied to a return start memory 50. The output signal of the memory 50 in turn is applied to an AND gate 51. A 100 yen coin insertion memory 52 is adapted to produce a signal "1" when the output "1" of the memory 50 produced in response to the insertion of the 100 yen coin is inverted by an inverter 61 and thereafter is applied to the memory 52 via an AND gate 62 as a readout signal "0". When the signal "1" is applied to the AND gate 51 form the memory 52, the AND condition of the AND gate 51 is satisfied and a signal "1" is applied from the AND gate 51 to the pulse control section PC.

It will be understood that the change payout mechanism is prevented from coming into operation when a signal "1" is read from the memory 52 by applying a signal "0" to one of the inputs of an AND gate 64 through an inverter 63.

The pulse control section PC then produces a pulse C shown in FIG. 4. The addition and subtraction counter AS receives 10 pulses from the AND circuit AN and effects subtraction of 100 yen. The subsequent return of the 50 yen and 10 yen coins is effected in the same manner as has previously been described with respect to the change payout operation.

A signal indicating that the 50 yen coin has been inserted is applied to a 50 yen insertion memory 54 from the pulse control section PC through an AND gate 53 and stored in the memory 54.

Since the output "1" of the AND gate 41 is inverted by an inverter 55 and thereafter is applied to one of the inputs of an AND gate 56, the output of the AND gate 56 becomes "0" and this signal "0" serves to read out the contents of the memory 54. The read out signal "1" energizes the 50 yen – 10 yen payout control section FS via an AND gate 57 and the OR gate 33. The subsequent operation for returning the 50 yen coin is the same as has been described with respect to the return of the 100 yen coin. Then the 10 yen coins are returned in a similar manner.

The operation of the machine in the event of shortage of coins in the coin tubes will now be described.

As switch $S_6$ provided for detecting whether the 10 yen coin tube is empty or not is changed over from the position shown in FIG. 2 and provides the OR gate 9 with a signal "0" in case the 10 yen coin tube has not a sufficient number of 10 yen coins required for delivering the change, this signal "0" is applied from the OR gate 9 to the AND gate 10. Accordingly, the AND gate 12 does not produce an output "1". In the meanwhile, an inverter 59 to which the switch $S_6$ is connected via the OR gate 9 produces an output "1". This output "1" is applied to one of the inputs of an AND gate 60. An output "1" of the memory 8 is applied to the other input of the AND gate 60. The AND gate 60 therefore produces an output "1" which is applied to the return memory 48 as a return instruction signal.

It will be understood from the foregoing that the state in which the machine is short of change is the same as the state in which the return switch $S_5$ is actuated and the inserted coin is returned as in the case of return mode.

While a coincidence signal is being applied to the AND gate 10 via the OR gate 9, a signal "1" continues to be applied to the AND gate 10 even when a signal "0" is applied to the OR gate 9 by switch $S_6$. Accordingly, the vend signal continues to be produced and the above described return operation is not performed.

In event the switches $S_1$, $S_2$ and $S_3$ have failed to function as they should, and a signal "0" only is applied, a signal "1" is produced from the pulse control section PC as described above and this signal "1" is applied to the coin return solenoid CA. This causes the pin to project into the coin path of the acceptor to return all of the inserted coins.

In the foregoing embodiment, the coin receiving and change payout operations are performed by switching of the vend switch $S_4$ after application of the output signal "1" of the AND gate 12 to the vend signal transmitter VE. It will be understood, however, that the same operations may be performed by applying the output of the AND gate 12 directly to the memory 15 as a vend instruction signal.

The switches used in the vending machine according to the invention need not be of a contact type but other types of switches such as a contactless type switch, a proximity switch and a phototransistor type switch may be used.

Figure 5:
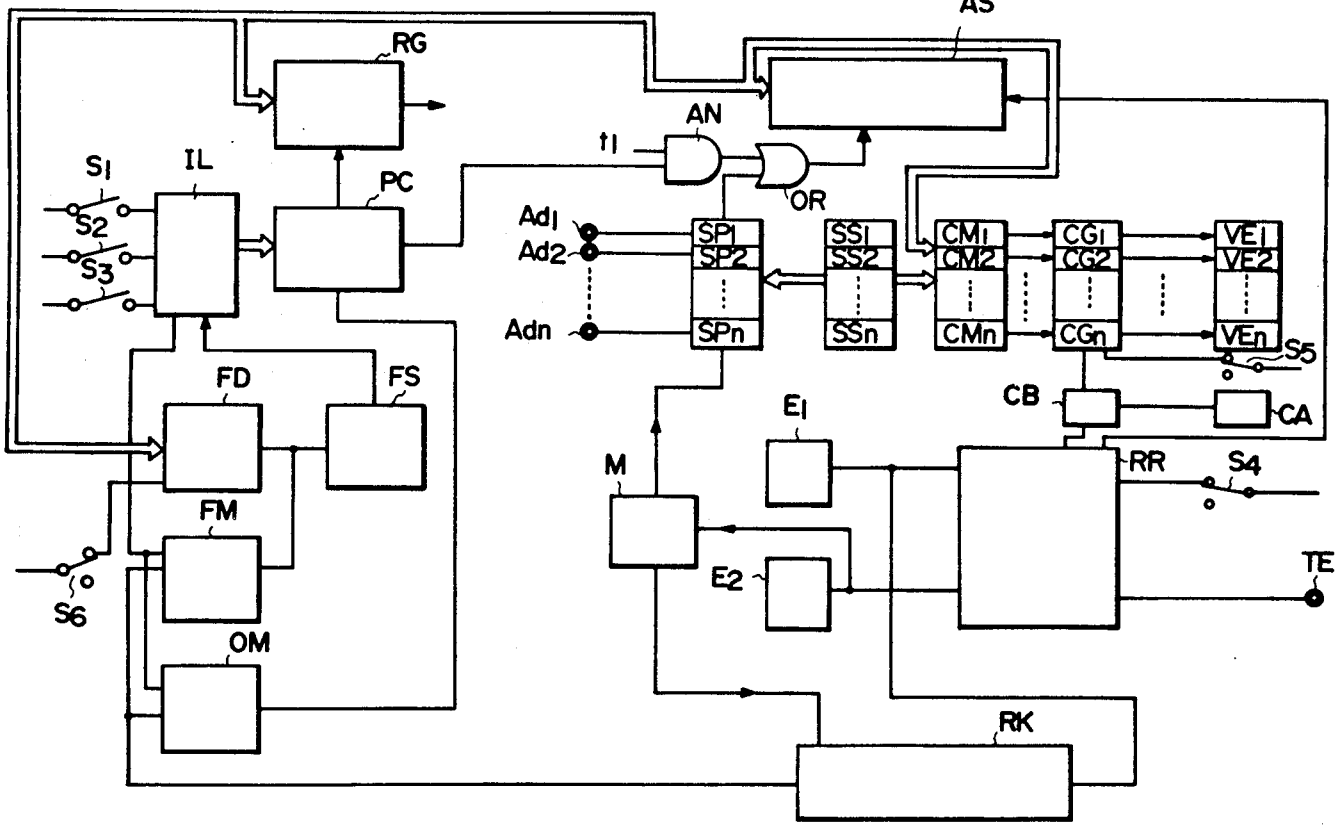
FIG. 5 is a block diagram schematically showing another embodiment of the vending machine according to the invention.

FIG. 5 is a block diagram illustrative of another embodiment of the vending machine according to the invention. The vending machine of this embodiment is adapted to deliver a a plurality of one and the same kind of article with a single coin depositing action.

In FIG. 5, the same component parts as those shown in FIG. 2 are designated by the same reference characters. Main differences between the embodiment shown in FIG. 5 and that shown in FIG. 2 are that in the former there are provided n units of price setting circuits CP, comparison circuits CM, vend signal storage control sections CG and vend signal transmitters VE (These circuit, sections and transmitters are distinguished from each other by suffix numbers attached to the reference characters.) and that in the former the vend signal from the vend circuit is applied directly to a return and receiving control section RR through a terminal TE.

One actual example of the circuit schematically shown in FIG. 5 will now be described with reference to FIG. 6. (In FIG. 6, the same component parts as those shown in FIG. 2 are designated by the same reference numerals.)

Upon insertion of one or more coins into the slot of the machine, a numeric value corresponding to the total sum of the inserted coin or coins is counted in the form of a binary information by the counter AS in the same manner as was previously described with respect to the embodiment shown in FIG. 1. Outputs $P_1$, $P_2$, . . . $P_5$ of the counter AS are applied to comparison circuits $CM_1$, $CM_2$ . . . $CM_n$. Each of the comparison circuits $CM_1$, $CM_2$ . . . $CM_n$ has a plurality of exclusive OR gates at its input section. These exclusive OR gates receive at one of their respective input terminals the outputs $P_1$, $P_2$ . . . $P_5$ and are connected at the other input terminals thereof to price setting circuits $SS_1$, $SS_2$, . . . $SS_n$. The price setting circuits $SS_1$, $SS_2$, . . . $SS_n$ are capable of setting desired vend prices and a vend price corresponding to the deisred number of article is set in each of the circuits $SS_1$, $SS_2$, . . . $SS_n$ in the form of a binary information. For convenience of explanation, let it be assumed that the circuit SS corresponds to a vend of one piece of the article and sets a price for the one piece, the circuit $SS_2$ corresponds to a vend of two pieces of the article and sets a price for the two pieces and the circuit $SS_n$ likewise sets a vend price for the *n* pieces of the article. Signals corresponding to the set prices are applied to the input of the exclusive OR circuits of the respective comparison circuits $CM_1$, $CM_2$ . . . $CM_n$ in the form of a binary information (5 bits in the illustrated embodiment). The output terminals of the exclusive OR circuits of the comparison circuits $CM_1$, $CM_2$ . . . $CM_n$ are respectively connected to the inputs of AND gates $CMA_1$,$CMA_2$ . . . $CMA_n$. Accordingly, the comparison circuits $CM_1$ – $CM_n$ produce a coincidence signal "1" when count of the counter AS coincides with the set price.

When a coincidence signal is produced from the comparison circuit $CM_1$, this coincidence signal is stored in a memory $8_1$ of the vend signal storage control section $CG_1$ and also applied to one of the inputs of AND gate $10_1$ of the same section $CG_1$ through an OR gate $9_1$. Since the AND gate $10_1$ also receives an output of the memory $8_1$, the AND gate $10_1$ produces an output "1". This output "1" is applied to one of the inputs of an AND gate $12_1$ through a flip-flop $11_1$. The AND gate $12_1$ constantly receives at the other input a signal "1" and, accordingly, the AND gate $12_1$ produces a signal "1" which drives a vend signal transmitter $VE_1$ to produce a vend signal.

In case the comparison circuits $CM_2 - CM_n$ produce a coincidence signal, vend signal storage sections $CG_2 - CG_n$ are likewise actuated to cause vend signal transmitters $VE_2 - VE_n$ to produce a vend signal.

It will be noted that if set price signals applied to the above described comparison circuits $CM_1 - CM_n$ are represented as $a$K (where K is a price of a single piece of the article and $a = 1, 2, \ldots n$), and the amount of the inserted coins, i.e., the counted value of the addition and subtraction counter as x ($a$K x ), all the comparison circuits receiving a signal representing a set price which is less than or equal to $x$ produce coincidence signal thereby causing vend signals corresponding to the respective comparison circuits to be produced. More specifically, if a vend price for a single piece of the article is set at 60 yen and three 100 yen coins are introduced in the machine, all the vend signal transmitters $VE_1 - VE_5$ produce their respective vend signals.

The reason for adopting the above described construction in which a plurality of vend signals are produced in accordance with the total amount of coins introduced is that the number of articles to be delivered cannot necessarily be determined at the instant when the purchaser has inserted the coins. Taking the above described case for example, it cannot be determined whether the purchaser's requirement is four pieces or five pieces of the article or he has erroneously supplied a superfluous amount of money notwithstanding the fact that his real intention was to purchase less pieces of the article. Accordingly, the present embodiment is so constructed that one to five pieces of the article may be selectively delivered in the above described case.

The number of article which the purchaser actually wants to have is determined upon depression of a selection switch of a vend circuit of which construction and operation will be described in detail hereinbelow.

Figure 7:
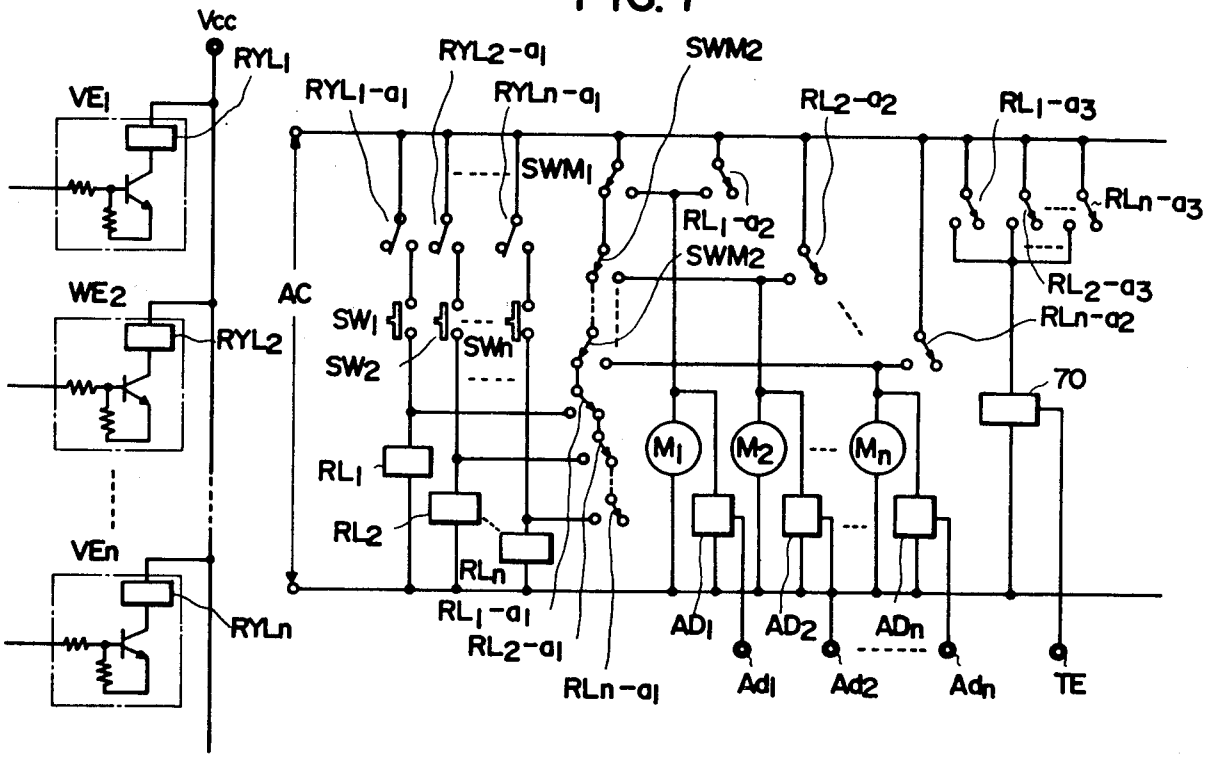
FIG. 7 is a circuit diagram showing one example of a vend signal transmitter and a vend circuit.

The outputs of the vend signal transmitters $VE_1 - VE_n$ are applied to the vend circuits for delivery of the number of article selected by the purchaser. FIG. 7 is a circuit diagram showing one example of the vend signal transmitter and the vend circuit. Referring to FIG. 7, the vend signal transmitters $VE_1 - VE_n$ comprise relay coils $RYL_1 - RYL_n$. Reference characters $RYL_1 - a_1$ through $RYL_n - a_1$ denote relay contacts switched by the actuation of the relay coils $RYL_1 - RYL_n$. An a-c power AC is applied to these relay contacts $RYL_1 - a_1$ through $RYL_n - a_1$. Selection switches $SW_1 - SW_n$ are provided respectively for the vend signal transmitters $VE_1 - VE_n$ so as to enable the purchaser to select a desired number of the articles. Accordingly, these selection switches $SW_1 - SW_n$ are provided in a number corresponding to the number of prices set in the vend price setting circuits $SS_1 - SS_n$. Motors $M_1 - M_n$ are provided for the selection switches $SW_1 - SW_n$ for delivering the wanted article to the purchaser. As either one of the selection switches $SW_1 - SW_n$ is depressed, the corresponding motor starts to be driven to deliver the required number of article to the purchaser. The driving of the motor is stopped upon completion of the delivery of the article. Switches $SWM_1 - SWM_n$ are carrier switches provided for the motors $M_1 - M_n$ for self-running of these motors $M_1 - M_n$ for a predetermined number of rotation. Reference characters $RL_1 - RL_n$ designate relay coils for self-holding and $RL_1$–$a_1$ through $RL_n$–$a_3$ relay contacts which are switched by the relay coils $RL_1 - RL_n$. A reference numeral 70 designates an ac-to-dc converter which is provided for providing the vend signal receiving terminal TE with a signal "1" upon setting of a selected one of the selection switches $SW_1 - SW_n$. Ac-to-dc converters $AD_1 - AD_n$ are respectively connected in parallel with the motors $M_1 - M_n$ for applying a signal "0" to terminals $Ad_1 - Ad_n$.

Assume that the relay coils $RYL_1$ and $RYL_2$ of the vend signal transmitters $VE_1$ and $VE_2$ are energized and the selection switch $SW_2$ is set. In this case, only the relay coil $RL_2$ is energized and the contacts $RL_2 - a_1$, $RL_2 - a_2$ and $RL_2 - a_3$ only are closed. Accordingly, the motor $M_2$ is driven to cause the switch $SWM_2$ to switch from the position shown in the figure thereby deenergizing the coil $RL_2$. The pieces of the required article are delivered by this driving of the motor $M_2$, Upon stopping of the motor $M_2$, the switch $SWM_2$ is switched back to the position shown in the figure. In the meanwhile, the closing of the contact $RL_2$–$a_3$ causes a signal "1" to be applied to the terminal TE via the ac-to-dc converter 70. This signal "1" is applied to the memory 15 (FIG. 6) and stored therein. Again, a signal "0" is applied from the ac-to-dc converter $AD_2$ to the terminal $AD_2$.

Referring again to FIG. 6, the output from the memory 15 is fed to the timer T$a$. After delaying action of the timer T$a$, the counter AS is changed to a subtraction ready state in the same manner as has previously been described. Since the AND gate 19 now receives the output of the inverter 17, the ouput of the AND gate 19 becomes "0". Thereupon the outputs of the AND gates $12_1 - 12_n$ become "0" and, accordingly, the vend signal transmitters $VE_1 - VE_n$ cease to produce the vend signals. The operation of the receiving solenoid $E_2$ thereafter is the same as was described with respect to the first embodiment.

An output signal "1" from the AND gate 21 is also applied to one of the inputs of an AND gate 65. The output of the AND gate 65 is applied to and stored in the flip-flop 26 via the OR gate 25. The flip-flop 26 is self-held by feeding back its output through the AND gate 27 and the OR gate 25 upon application thereto of a pulse DP. The output "1" of the flip-flop 26 is also applied to a flip-flop 28.

The output terminal of the flip-flop 28 is connected to one of the input terminals of an AND gate 30 via an inverter 29. Accordingly, all inputs of the AND gate 30 and "1" while the flip-flop 26 produces an output "1" and the flip-flop 28 has not received the pulse DP yet. The AND gate 30 therefore produces an output "1".

The output "1" of the AND gate 30 is applied to AND gates $AP_1 - AP_5$ of subtraction pulse transmitters $SP_1, SP_2 \ldots SP_n$. Accordingly, the signals from the price setting circuits $SS_1 - SS_n$ are produced from OR gates $A_1 - A_n$ through timing by the pulses $t_1 - t_5$ shown in FIG. 4. The outputs of the OR gates $A_1 - A_n$ are respectively applied to AND gates $67_1 - 67_n$. The AND gates $67_1 - 67_n$ also receive outputs of the ac-to-dc converters $AD_1 - AD_n$ from the terminals $Ad_1 - Ad_n$ via inverters $68_1 - 68_n$. The outputs of the ac-to-dc converters $AD_1 - AD_n$ are also applied to a logic circuit 69 via the terminals $Ad_1 - Ad_n$ and the inverters $68_1 - 68_n$.

The logic circuit 69 is constructed in such a manner that it produces an output "1" when either one of the outputs of the invertors $68_1 - 68_n$ is "1". The ac-to-dc converters $AD_1 - AD_n$ respectively produce an output "0" when the corresponding selection switches $SW_1 - SW_n$ (FIG. 7) are set and the corresponding motors $M_1 - M_n$ are driven. Accordingly, the signal "0" is applied to one of the terminals $Ad_1 - Ad_n$ corresponding to one of the switches $SW_1 - SW_n$ selected by the purchaser whereby the AND condition of the AND gate 65 is satisfied, whereas the AND condition is also satisfied in one of the AND gates $67_1 - 67_n$ corresponding to the terminal to which the signal "0" is applied. One of the OR gates $A_1 - A_n$ corresponding to this AND gate produces an output which is applied to the OR gate 66 through the corresponding one of the AND gates $67_1 - 67_n$ and further to the addition and subtraction counter AS through the OR gate OR.

Thus, a value corresponding to the set price of the selected number of article is subtracted from the value stored in the counter AS. Since the interval at which the pulse $t_1$ appears from the pulse $t_5$ is equal to the interval of the shift pulse $\phi_1$, subtraction is effected at each bit. If the set price coincides with the amount of the inserted coins, all of the outputs $P_1 - P_5$ of the respective stages of the register of the counter AS become "0" whereby the whole circuit is reset by the reset circuit RG.

It will be understood from the foregoing that the counted value of the addition and subtraction counter AS becomes difference between the amount of the inserted coins and the set price. In case this difference is not 0, an amount of money corresponding to this difference is payed out as change. The change payout operation is performed in the same manner as has previously been described with respect to the first embodiment.

Next to be described is an operation performed in a case where the change coin tube is short of change coins. In case there is shortage of change, a 10 yen shortage detection switch $S_6$ is actuated to supply a signal "0" to one of the inputs of each of AND gates $10_1, 10_2 \ldots 10_n$ through OR gates $9_1, 9_2 \ldots 9_n$. Accordingly, when the shortage of change occurs, AND gates $12_1, 12_2 \ldots 12_n$ which are connected to the outputs of the AND gates $10_1, 10_2 \ldots 10_n$ do not produce a signal "1". Since the switch $S_6$ is also connected to an inverter 59 through the OR gates $9_1, 9_2 \ldots 9_n$, the output of the inverter 59 is "1" and applied to one of the inputs of an AND gate 60. The AND gate 60 receives at the other input thereof a signal "1" from a memory $8_n$ so that the AND gate 60 produces an output "1" which is supplied to a return memory 48 as a return instruction signal.

Accordingly, if there occurs shortage of change and a signal "1" is produced from the comparison circuit $CM_n$ of the most significant digit, the device is brought into a state which is the same as in the case where the return switch $S_4$ is actuated whereby the inserted coin or coins are returned to the purchaser.

While a coincidence signal is applied to the AND gate $10_n$ via the OR gate $9_n$, the AND gate $10_n$ continues to produce a signal "1" even when the 10 yen coin shortage detection switch $S_6$ applies a signal "0" to the OR gate $9_n$. Thus, a vend signal is produced and the above described return operation is not performed.

As described in the foregoing, this embodiment is extremely convenient in a case where the purchaser wants a plurality of pieces of the same kind of article since the machine is capable of vending a desired number of the article within an amount of the inserted coins.

Figure 6:
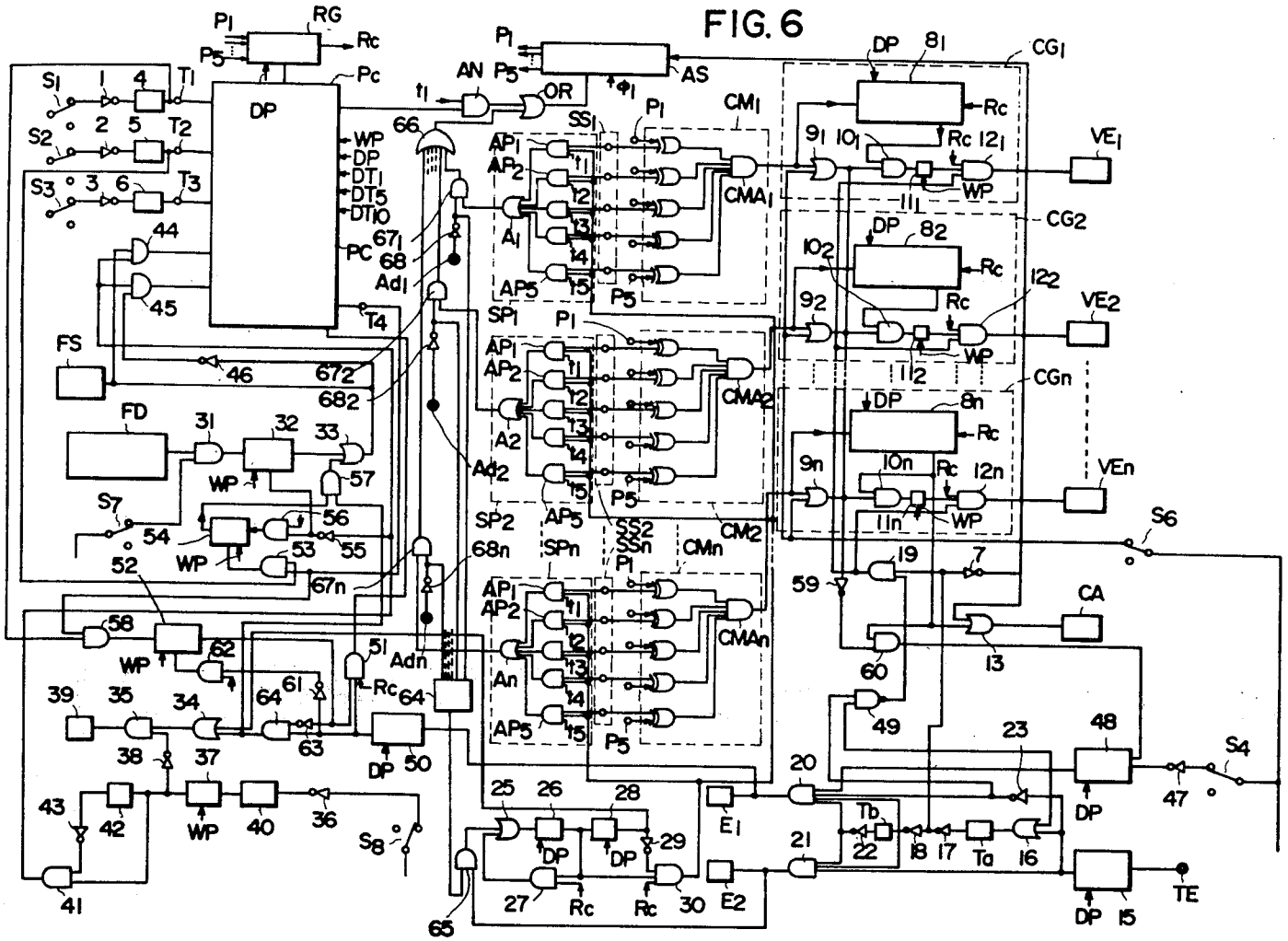
FIG. 6 is a detailed circuit diagram of the embodiment shown in FIG. 5.

The embodiment described with reference to FIGS. 5 – 7 is so constructed that a plurality of pieces of one and the same article can be delivered. It will be noted that a plurality of kinds of articles may be delivered by the machine of the same construction as described above. For this purpose, selling prices respectively corresponding to different articles are preset in the price setting circuits $SS_1 - SS_n$ in the form of binary information and the selection switches $SW_1 - SW_n$ are made to correspond to the respective articles.

The addition and subtraction counter employed in the above described vending machine consists of a plurality of flip-flop circuits. This type of counter, however, tends to make an erroneous operation when the power is turned on or when the machine is at a stand-by, i.e. the coin has not been inserted in the slot yet and the counter has not started its counting operation, because the flip-flop circuits of the counter are unintentionally inverted due to noise which often occurs on such occasions. The tendency to the erroneous operation of the addition and subtraction counter of the vending machine poses a very serious problem because the vending machines are usually located along the street and the counter is subject to the adverse effect of a very complicated noise. Again, since a regular clock pulse is not produced before a lapse of certain time after turning-on of the power, the addition and subtraction counter which is controlled by this clock pulse is placed in a very unstable state during this transient period. The counter therefore is likely to make an erroneous counting operation is case, for example, a coin is inserted in the machine immediately after the turning-on of the power.

Figure 8:
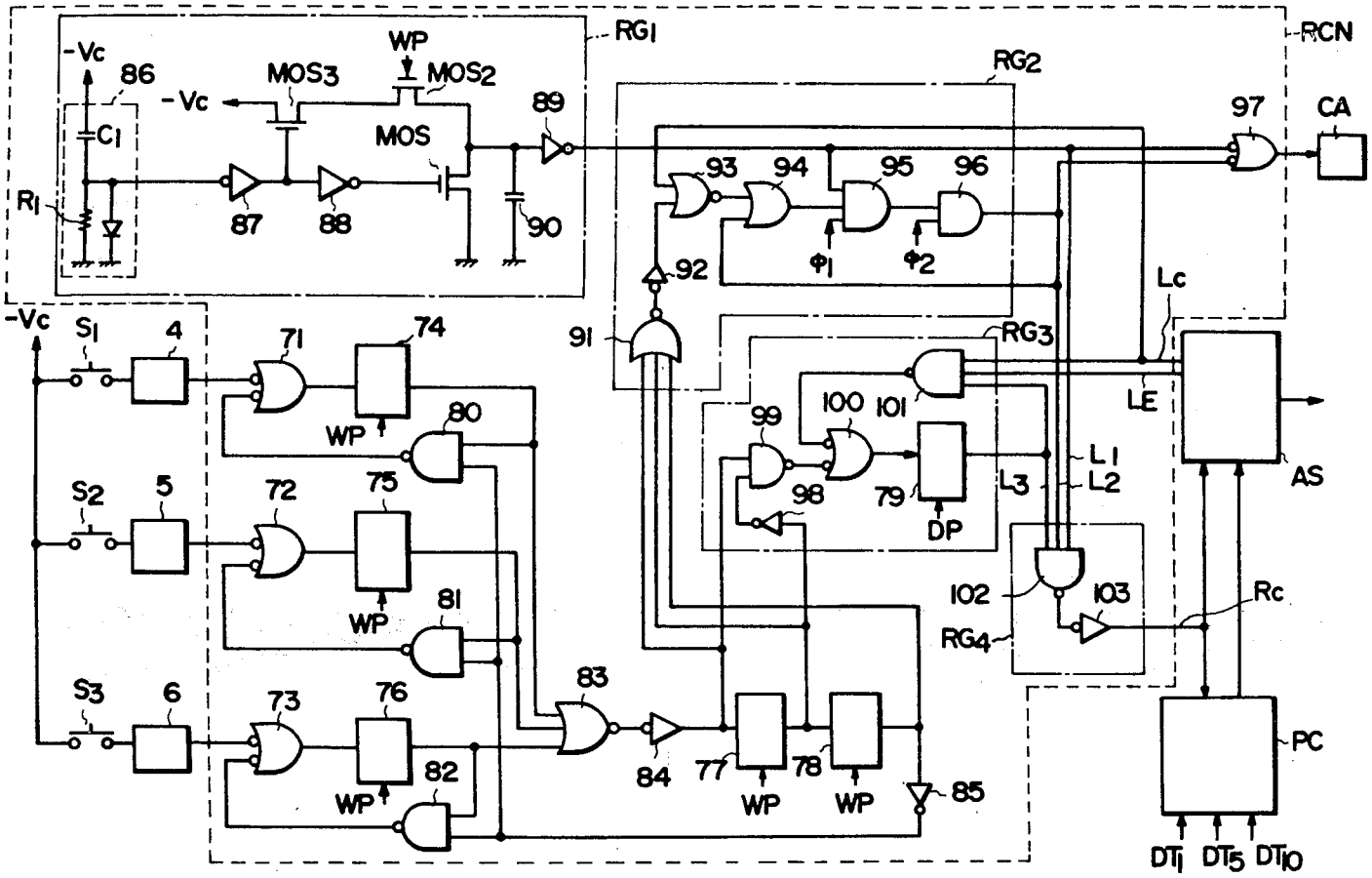
FIG. 8 is a block diagram showing one example of a reset control device.

According to the present invention, a reset control device is provided for preventing such erroneous operation of the counter. FIG. 8 illustrates one example of such reset control device which may be used with the control system as shown in FIGS. 1 and 2 and FIGS. 5 – 7. FIG. 8 therefore shows the internal construction of a reset control device RCN as well as connections of the device with the coin return solenoid CA, the addition and subtraction counter AS, the pulse control section PC and the chattering preventing circuits 4, 5, 6.

In FIG. 8, the outputs of the chattering prevention circuits 4, 5 and 6 are respectively applied to corresponding flip-flops 74, 75 and 76 through NOR circuits 71, 72 and 73. The outputs of the flip-flops 74, 75 and 76 in turn are supplied to a flip-flop 78 through a NOR circuit 83, an inverter 84 and a flip-flop 77. The flip-flops 74 - 76 are adapted to temporarily store the signal "1" applied from the NOR circuits 71 – 73 and gate out this signal "1" upon application of the working pulse WP of a predetermined interval as shown in FIG. 4. The flip-flops 77 and 78 likewise gate out a signal "1" stored temporarily therein upon application of the working pulse WP. The output of the flip-flop 78 is applied to NAND circuits 80, 81 and 82 through an inverter 85. The NAND circuits 80 – 82 receive at the other input terminals thereof the outputs of the corresponding flip-flops 74, 75 and 76. The outputs of the NAND circuits 80, 81 and 82 are applied to the flip-flops 74, 75 and 76 through the NOR gates 71, 72 and 73.

Thus, the signal "1" which is once stored in the flip-flops 74, 75 and 76 is passed through the NAND circuits 80, 81 and 82 and stored again in the flip-flops 74, 75 and 76 for self-holding. When a signal "1" is produced from the flip-flop 78, the condition of the NAND circuits 80, 81 and 82 is not satisfied whereby the flip-flops 74, 75 and 76 are released from self-holding.

The flip-flop 78 produces an output "1" at the third word after the detection switches $S_1 - S_3$ are actuated to apply a signal "0" to the NOR circuits 71 – 73, i.e. upon application of three shots of the pulse WP, thereby releasing the flip-flops 74, 75 from self-holding. The flip-flops 74, 75 and 76 therefore produce an output "0" at the fourth word.

A reset signal transmitter $RG_4$ receives output signals of a power-turning-on reset control section $RG_1$, a stand-by identification control section $RG_2$ and a stand-by reset control section $RG_3$ through lines $L_1$, $L_2$ and $L_3$ respectively. When either one of the signals on the lines $L_1 - L_3$ is "0", the output of NAND circuit 102 becomes "1" and a signal "0" is output from an inverter 103 as a reset signal Rc. The addition and subtraction counter AS and the pulse control section PC are reset by this signal "0". When the signals on the lines $L_1 - L_3$ are all "1", the addition and subtraction counter AS and the pulse control section PC are set by this signal "1". The "resetting" of the addition and subtraction counter AS means non-performance of the counting operation and maintenance of the count at zero without likelihood of the erroneous operation due to noise etc., whereas the "setting" of the counter means an operable condition of the counter. The operations of the respective control sections $RG_1 - RG_3$ will be described in detail hereinbelow.

The power-turning-on reset control section $RG_1$ provides a signal "0" on the line $L_1$ during a transient time from turning-on of the power till the start of oscillation of regular clock pulses thereby providing the reset signal Rc during this time. In the example illustrated in the figure, the control section $RG_1$, comprises a CR time constant circuit 86 having a capacitor $C_1$ connected to a negative power source $-Vc$. The output of the time constant circuit 86 is applied to a MOS field-effect transistor (hereinafter referred to as "MOS transister") $MOS_1$ through inverters 87 and 88. The drain of the MOS transistor $MOS_1$ is connected to the input of an inverter 89. A MOS transistor $MOS_3$ is connected at the gate thereof to the output of the inverter 87 and, at the drain thereof, to the negative power source $-Vc$. The MOS transistor $MOS_3$ is further connected at the source thereof to the drain of the MOS transistor $MOS_2$. The working pulse WP is applied to the gate of the MOS transistor $MOS_2$. The MOS transistor $MOS_2$ is connected at the source thereof to the input of the inverter 89 and also to a capacitor 90 which is grounded. Thus, the output of the inverter 89 is applied to a NAND circuit 102 through the line $L_1$.

The charging time for the CR time constant circuit 86 is determined in accordance with the time required for a stable oscillation of the clock pulse. When the power is turned on, the output of the time constant circuit 86 is at a low level and therefore constitutes the signal "0" during a certain period of time. Accordingly, the output of the inverter 87 becomes a signal "1" and that of the inverter 88 a signal "0". This brings the MOS transistor $MOS_1$ into conduction whereby the input side of the inverter 89 is brought into a high level (ground potential) and a signal "1" is applied to the inverter 89. Thus, a signal "0" is applied to the NAND circuit 102 via the line $L_1$ and the inverter 103 outputs a signal "0" thereby resetting the addition and subtraction counter AS. The output "0" of the inverter 89 is also applied to a NOR circuit 97. The output of the NOR circuit 97 is fed to a coin return solenoid CA. The solenoid CA is actuated upon receipt of a signal "1" from the NOR circuit 97 to return the inserted coin or coins to the purchaser.

When the output of the time constant circuit 86 becomes "1" after a lapse of the predetermined time, the output of the inverter 87 becomes "0" thereby bringing the MOS transistor $MOS_3$ into conduction. In the meanwhile, the working pulse WP which is produced upon stabilization of the oscillation of the clock pulse is applied to the gate of the MOS transistor $MOS_2$ thereby bringing it into conduction and the MOS transistor $MOS_1$ into non-conduction. Accordingly, charging of the capacitor 90 is started. When the charging has been completed, the input side of the inverter 89 becomes a signal "0" and a signal "1" is applied to the NAND circuit 102 via the line $L_1$. Accordingly, production of the reset signal Rc depends upon the signals on the other lines $L_2$ and $L_3$.

The stand-by identification control section $RG_2$ is adapted to provide the NAND circuit 102 with a signal "0" via the line $L_2$ and thereby cause the NAND circuit 102 to produce the reset signal Rc during a period of time from the turning-on of the power till recognition of the fact that none of the detection switches $S_1$, $S_2$ and $S_3$ is producing a signal "0" due to malfunction thereof and that the addition and subtraction counter AS is not making miscounting. The outputs of the inverter 84 and the flip-flops 77 and 78 are applied to a NOR circuit 91 and supplied to a NOR circuit 93 via an inverter 92. The NOR circuit 93 also receives a count signal from the addition and subtraction counter AS via the line Lc. The count signal is "0" when the count of the counter AS is zero and "1" when the count is a value other than zero. The output of the NOR circuit 93 is applied to an AND gate 95 via an OR gate 94. The AND gate 95 also receives the output of the inverter 89 and the pulse $\phi_1$ shown in FIG. 4. The output of the AND gate 95 is applied to one of the inputs of an AND gate 96 which receives at the other input thereof the pulse $\phi_2$ shown in FIG. 4. The output of the AND gate 96 is fed to a NAND circuit 102 via the line $L_2$ and also to an OR gate 94. The pulses $\phi_1$ and $\phi_2$ are locked in the AND gates 95 and 96 once they have been applied to these AND gates and, accordingly, a signal "1" continues to be applied to them. The output of the AND gate 96 is applied also to a NOR circuit 97.

Assume that the oscillation of the clock pulse has now been stabilized and a signal "1" is applied from the inverter 89 to the AND gate 95. Assume further that the pulses $\phi_1$ and $\phi_2$ are respectively applied to the AND gates 95 and 96. If either one of the detection switches $S_1 - S_3$ is out of order and produces a signal "0", the output of the NOR circuit 91 becomes "0" and a signal "1" is applied to the NOR circuit 93 via the inverter 92. Accordingly, the AND gates 95 and 96 respectively produce an output "0" and the signal "0" is applied to the NAND circuit 102 via the line $L_2$ resulting in production of the reset signal Rc. The same operation as the above described one is performed in a case where the addition and subtraction counter AS makes miscounting and a signal "1" is applied to the NOR circuit 93 via the line Lc.

If a coin is inserted in this state, the coin will be returned to the purchaser because the signal "0" is being applied from the AND gate 96 to the NOR circuit 97 thereby actuating the coin return solenoid CA. When the counter AS is not making miscounting and the switches $S_1 - S_3$ are not making an erroneous operation, the signals applied to the NOR circuit 93 are both "0". Accordingly, the AND gates 95 and 96 respectively produce an output "1", and a signal "1" is applied to the NAND circuit 102 via the line $L_2$. Thus, production of the reset signal Rc depends upon the signal on the line $L_3$. The signal "1" of the AND gate 96 is also applied to the OR gate 94 to maintain the signal "1" of the AND gate 96 in a self-holding state. Accordingly, once the stand-by condition is confirmed after turning-on of the switch, the signal "1" on the line $L_2$ remains constant even if the switches $S_1 - S_3$ are actuated and the counter AS performs a counting operation.

The stand-by reset control section $RG_3$ is constructed in such a manner that while a coin is not inserted and a series of addition and subtraction counting operation is not performed, the control section $RG_3$ constantly supplies a signal "0" to the NAND circuit 102 via the line $L_3$ to cause the NAND circuit 102 to produce the reset signal Rc, and if one of the switches $S_1 - S_3$ is actuated, NAND circuit 102 ceases to produce the reset signal Rc and thereafter is prevented from producing the reset signal Rc until a series of counting operation is completed.

The NAND circuit 99 receives the output of the inverter 84 and also the output of the flip-flop 77 which is applied through the inverter 98. The output of the NAND circuit 99 is applied to a flip-flop 79 through a NOR circuit 100. The input signal to the flip-flop 79 is temporarily stored therein and thereafter is read out upon application of the pulse DP shown in FIG. 4. The readout signal is fed to the NAND circuit 102 via the line $L_3$ and to the NAND circuit 101. The NAND circuit 101 receives also the count signal and applied from the addition and subtraction counter AS via the line Lc and an error signal applied via the line LE. The error signal becomes "0" when the count of a reversible conter (not shown) of the addition and subtraction counter AS becomes a negative value by subtraction and otherwise is "1". Assume that signals "1" are being applied to the NAND circuit 102 via the lines $L_1$ and $L_2$ and a coin is not introduced in the machine. The output of the inverter 84 is "0" and that of the inverter 98 is "1". The output of the NAND circuit 99, therefore, is a signal "1" and the output of the NOR circuit 100 is a signal "0". Accordingly, the flip-flop 79 provide the NAND circuit 102 with a signal "0" via the line $L_3$ thereby producing the reset signal Rc. Thus, the addition and subtraction counter AS is constantly reset.

If a coin is inserted and the switch $S_1$ thereby is actuated the flip-flop 74 produces a signal "1" upon application thereto of a first working pulse WP. This signal "1" is applied to the NAND circuit 99 via the inverter 84. Since the output of the flip-flop 77 at this time is "0", the NAND circuit 99 supplies a signal "1" to the flip-flop 79 via the NOR circuit 100. The flip-flop 79 produces a signal "1" upon receipt of the pulse DP and, accordingly, the output of the inverter 103 connected to the output of the NAND circuit 102 becomes "1" whereby the production of the reset signal Rc ceases. Thus, the counter AS is set and capable of counting. The amount of the introduced coins is now calculated and the signals on the lines $L_C$ and $L_E$ become "1". Since the output of the flip-flop 79 is a signal "1", the NAND circuit 101 provides the NOR circuit 100 with a signal "0". The flip-flop 79 therefore receives a signal "1" thereby maintaining the signal "1" on the line $L_3$ in self-holding. When count signal on the line $L_C$ becomes "0" upon completion of the operation of the counter AS for subtracting the price from the deposited amount has finished, the NAND condition of the NAND circuit 101 is no longer satisfied and, accordingly, the flip-flop 79 produces an output "0" thereby producing the reset signal Rc again.

As will be understood from the foregoing, the reset control device is capable of effectively preventing the addition and subtraction counter AS from making a faulty operation due to external noises by ensuring an accurate resetting of the counter in the stand-by state. The reset control device is also capable of preventing the erroneous operation of the counter AS due to failure in production of regular pulses by having the counter AS reset and an inserted coin returned during the transient period from turning-on of the power till the start of oscillation of a regular clock pulse. Thus, the purchaser will be protected from suffering an unexpected loss of his coin.

Figure 9:
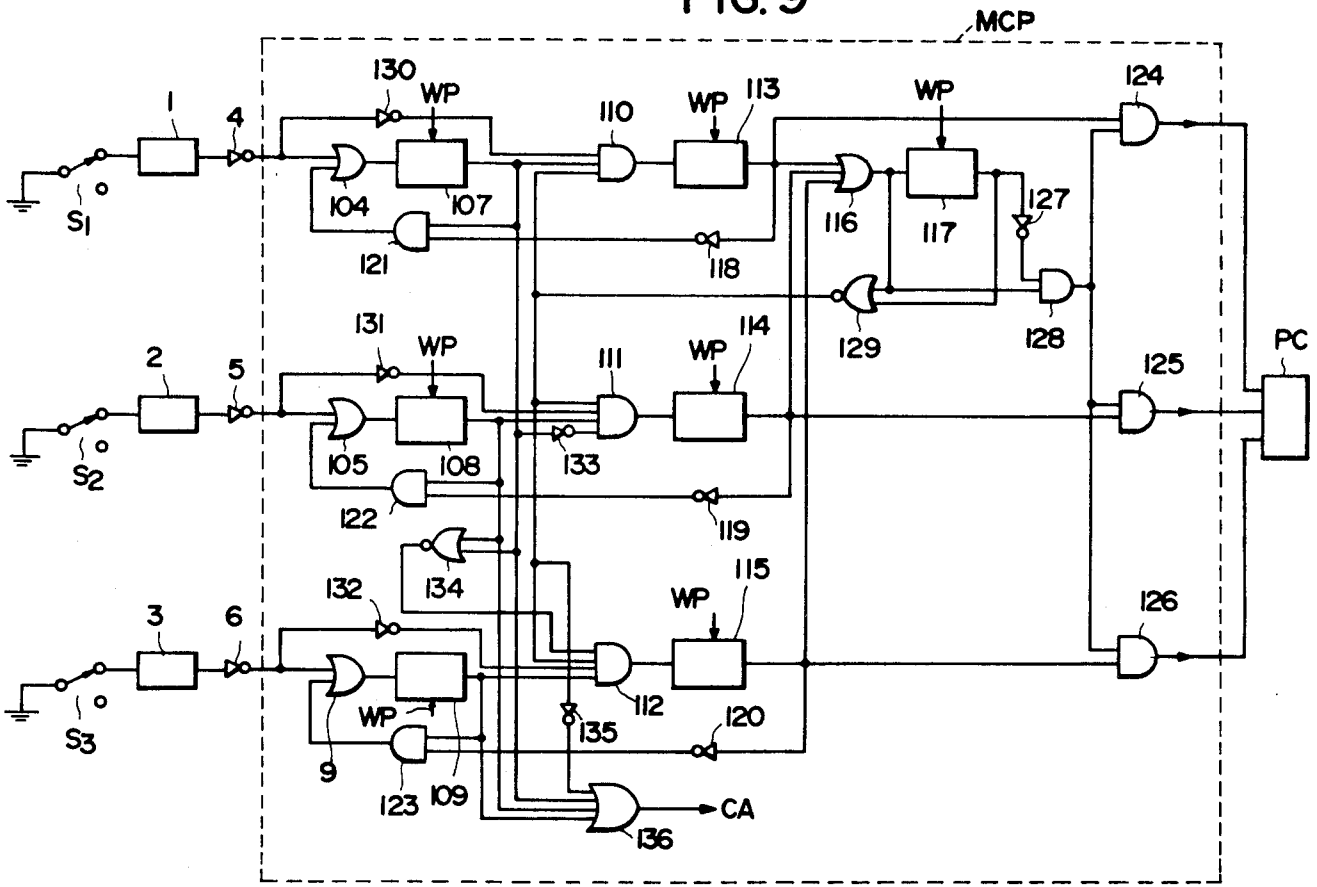
FIG. 9 is a block diagram showing one example of a miscount prevention device.

In a vending machine, various kinds of coins are inserted and, if two or more kinds of coins have actuated the detection switches simultaneously due to delay in passing of the preceding coin or insertion of the coins in rapid succession, there occurs miscount, i.e., the exact amount of the inserted coin is not calculated. According to the invention, a miscount prevention device is provided to prevent occurence of such miscount. FIG. 9 is illustrative of one example of the miscount prevention device which is provided between the detection switches $S_1 - S_3$ and the pulse control section PC.

In FIG. 9, the chattering prevention circuits 4, 5 and 6 respectively produce detection signals upon insertion of the different kinds of coins.

Flip-flops 107, 108 and 109 temporarily store a signal "1" applied from their corresponding OR gates 104, 105 and 106 and output the signal "1" upon receipt of the working pulse WP of a predetermined pulse interval. The outputs of the flip-flops 107, 108 and 109 are respectively applied to flip-flops 113, 114 and 115 through AND gates 110, 111 and 112. The output terminals of the flip-flops 113, 114, and 115 are connected to a flip-flop 117 through an OR gate 116. These flip-flops 113 and 114, 115 and 117 are also receiving the working pulse WP.

The outputs of the flip-flops 113, 114 and 115 are applied to AND gates 121, 122 and 123 via inverters 118, 119 and 120 and also to AND gates 124, 125 and 126 respectively. The AND gates 121, 122 and 123 receive also the outputs of the flip-flops 107, 108 and 109 respectively. Accordingly, the signal "1" temporarily stored in the flip-flops 107, 108 and 109 is self-held by being again stored therein through the AND gates 121, 122 and 123. This self-holding is released when the signal "1" is output from these flip-flops 113, 114 and 115.

The AND gates 124, 125 and 126 receive also the output of the flip-flop 117 through an inverter 127. The AND gates 124, 125 and 126 respectively correspond to the kinds of coinage used in the vending machine. The outputs of these AND gates 124, 125 and 126 are applied to the counter (not shown) as coin detection signals for addition of the amounts of the inserted coins.

The output of the flip-flop 117 is fed to the AND gates 110, 111 and 112 through a NOR circuit 129. The output of the OR gate 116 is applied to the NOR circuit 129 and also to the AND gate 128.

The AND gates 110, 111 and 112 receive also the outputs of the inverters 4, 5 and 6 via inverters 130, 131 and 132 respectively. The AND gate 11 further receives the output of the flip-flop 107 through an inverter 133. The AND gate 112 further receives the output of a NOR circuit 134 which receives the outputs of the flip-flops 107 and 108.

The outputs of the flip-flops 107, 108 and 109 and the output of an inverter 135 connected to the output terminal of the NOR circuit 129 are applied to the coin return solenoid CA via an OR gate 136. This solenoid CA is provided for projecting the pin into and withdrawing the same from the coin passage of the acceptor A. When a signal "1" is applied to the solenoid CA, the solenoid is deenergized to project the pin into the coin passage. A coin inserted in the slot thereafter is blocked by the pin and delivered to the coin return outlet OUT.

Accordingly, the inserted coin is rejected when either one of the flip-flops 107 - 109 is producing a signal "1" whereby a successive insertion of coins which is likely to cause miscounting of the counter is prevented. Furthermore, in case a signal "0" is produced due to incomplete contact of either one of the switches $S_1 - S_3$, an inserted coin is rejected by application of a signal "1" to the solenoid CA from the corresponding one of the flip-flops 107 – 109.

The operation of the miscount prevention device will be described with reference to a case wherein the switches $S_1$, $S_2$ and $S_3$ have been simultaneously actuated.

The insertion detection signal "0" from the respective switches $S_1$, $S_2$ and $S_3$ are inverted by the inverters 4 – 6 and the output "1" of the inverters 4 – 6 are stored in the flip-flops 107 – 109 through the OR gates 104 – 106. The stored signal "1" is read out one word (e.g. 1ms) later upon application of the pulse WP. The read out signal "1" is applied to the AND gates 110, 111 and 112 and the AND gates 121, 122 and 123. Since the outputs of the flip-flops 113, 114 and 115 in this stage are "0", the AND conditions of the AND gates 110, 111 and 112 are satisfied and these AND gates are self-held. In the meanwhile, the AND gates 110, 111 and 112 receive an output "1" of the NOR circuit 129. The AND gate 111 further receives a signal "0" from the inverter 133 and the AND gate 112 a signal "0" from the NOR circuit 134. If the switches $S_1$, $S_2$ and $S_3$ are actuated from this state, the outputs of the inverters 130, 131 and 132 become "1" and these outputs "1" are applied to the AND gates 110, 111 and 112. The AND gate 110 accordingly provides the flip-flop 113 with a signal "1". The signal "1" is read out one word later (two words counting from the beginning) and stored, in the flip-flop 117 via the OR gate 116. The signal "1" from the flip-flop 113 is also applied to the inverter 118 and the output "0" of the inverter 118 is applied to the AND gate 121. The flip-flop 107 thereby is released from self-holding. The output "1" of the flip-flop 113 is applied also to the AND gate 124. Since the output of the AND gate 128 at this time is "1", the AND gate 124 produces a 100 yen coin detection signal.

The signal "1" stored in the flip-flop 117 is read out one word later (three words counting from the beginning) whereby the output of the AND gates 128 and 124 become "0". The output of the flip-flop 117 becomes "0" still one word later (four words counting from the beginning) and, accordingly, the NOR circuit 129 produces an output "1".

When the output of the NOR circuit 129 has become "1", the AND gate 111 which has already received a signal "1" from the inverter 133 produces an output "1". This output "1" is stored in the flip-flop 114 and read out one word later (five words counting from the beginning). This output signal "1" serves to release self-holding of the flip-flop 108 as well as to cause the AND gate 125 to produce a 50 yen coin detection signal. In the meanwhile, the output "1" of the flip-flop 114 is stored in the flip-flop 117 via the OR gate 116 whereupon the output of the OR gate 16 becomes "0" and the AND condition of the AND gate 111 is no longer satisfied. The flip-flop 117 produces a signal "1" one word later (six words from the beginning) whereby the outputs of the AND gates 128 and 125 become "0". Still one word later (seven words from the beginning), the output of the flip-flop 117 becomes "0" and, accordingly, the output of the NOR circuit 129 becomes "1".

When the output of the NOR circuit 129 become "1", the AND gate 112 produces an output "1" since the output of the NOR circuit 134 has already become "1". The output "1" of the AND gate 112 is stored in the flip-flop 115 and read out one word later (eight words counting from the beginning). This output "1" releases the flip-flop 109 from self-holding and causes the AND gate 126 to produce a 10 yen coin detection signal. Thus, the 100 yen, 50 yen and 10 yen detection signals are sequentially produced with a proper time interval therebetween.

It will be understood from the above description that in case two or more switches are actuated within one word time, a detection signal for a coin of higher precedence is produced first and a detection signal for a coin of lower precedence is produced only after the detection of the coin of higher precedence is recognized by the flip-flop 117 (i.e. the flip-flop 117 has produced a signal "1").

Accordingly, when these coin detection signals are supplied to the counter for counting of the amount of the inserted coins, no two or more detection signals are provided simultaneously so that miscounting of the counter will be completely avoided.

It should be noted that if a switch for a coin of lower precedence, e.g. $S_3$, is actuated more than one word time prior to actuation of a switch for a coin of higher precedence, e.g. $S_1$, the detection operation of the switch $S_3$ for a lower precedence coin precedes that of the switch $S_1$ for a higher precedence coin.

In the above description, the terms "higher precedence" or "lower precedence" do not mean the denomination of coinage but an order of precedence in the production of the detection signals. In the present embodiment, the detection signals are produced in the order of a 100 yen coin, a 50 yen coin and a 10 yen coin if the three switches are simultaneously actuated. It will be understood, however, that the order of precedence may be changed as desired without reducing the effect of the miscount prevention device.

One preferred example of the coin control device according to the invention will be described hereinbelow.

FIG. 10 is a front elevational view of the coin control device illustrative of passage of the inserted coin. The device comprises an acceptor A adapted to sort out a plurality of coins (100 yen, 50 yen and 10 yen coins in the present example), pass the sorted out coins to their corresponding outlets upon insertion thereof and, when the device is in a "reject" state, pass all of the inserted coins to a return outlet, and a coin control mechanism B including a mechanism for introducing 10 yen and 50 yen coins among the coins sorted out by the acceptor A respectively into a 10 yen coin tube and a 50 yen coin tube and, in case the coin tube is full, introducing the inserted coin to a cash box, a mechanism for temporarily retaining a 100 yen coin on a mechanical principle, a mechanism for returning the temporarily retained 100 yen coin in a return position and introducing the retained 100 yen coin into the cash box in an accept position, and a mechanism for paying out change from the respective coin tubes.

In the reject position, the inserted 50 yen coin passes from a path $l_1$ down a path $l_7$ to an outlet 140 of the acceptor A. The 10 yen coin passes from a path $l_3$ down a path $l_8$ to the outlet 140. Likewise, the 100 yen coin passes from a path $l_5$ down a path $l_9$ to the outlet 140. These coins are then led to a main return path 141 of the coin control mechanism B and returned from an outlet OUT. In the accept position, the 50 yen coin passes paths $l_1$ and $l_2$ to an outlet 139. The 10 yen coin passes paths $l_3$ and $l_4$ to an outlet 137. The 100 yen coin passes paths $l_5$ and $l_6$ to an outlet 138. These coins are then led to the coin control mechanism B. The relative disposition of the outlets 137, 138 and 139 is illustrated in FIG. 10 (*b*).

In the coin control mechanism B, the 10 yen coin is received in a 10 yen coin tube $C_2$ or, when the coin tube $C_2$ is full of 10 yen coins, introduced into the cash box via a path $l_{14}$. The 50 yen coin is received in a 50 yen coin tube $C_1$ or, when the coin tube $C_2$ is full, introduced into the cash box via a path $l_{13}$. The 100 yen coin passes through a path $l_{12}$ to a position G where it is temporarily retained by means of a retaining mechanism to be described later. The 100 yen coin thereafter is led to the main return path 141 via a path $l_{15}$ in the return state or to the cash box via a path $l_{16}$.

The acceptor A comprises a coin return device which is capable of returning the inserted coin in a vend stop state caused by stoppage of electricity or exhaustion of articles to be vended by energizing the coin return solenoid CA. One preferred example of such coin return device will now be described.

Figure 11:
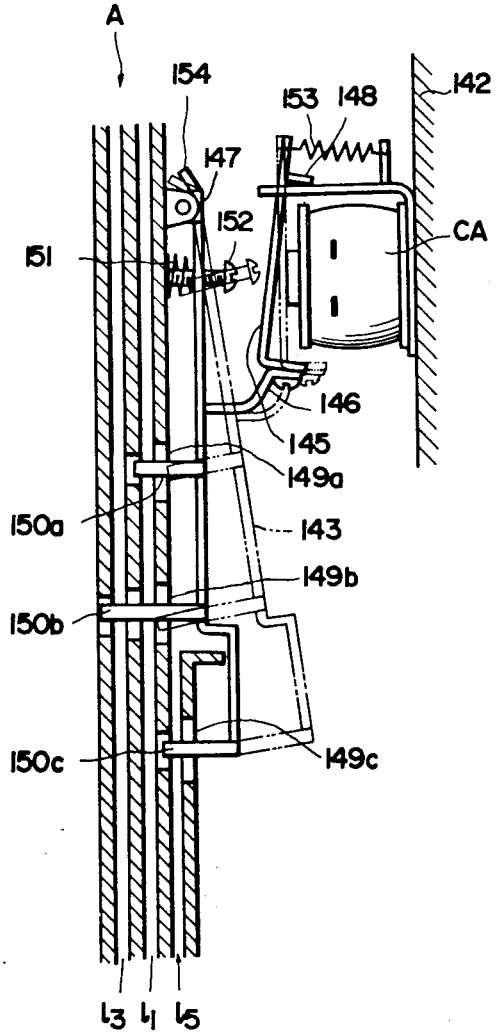
FIG. 11 is a side elevational view showing one example of a coin return device partly in section.
Figure 12:
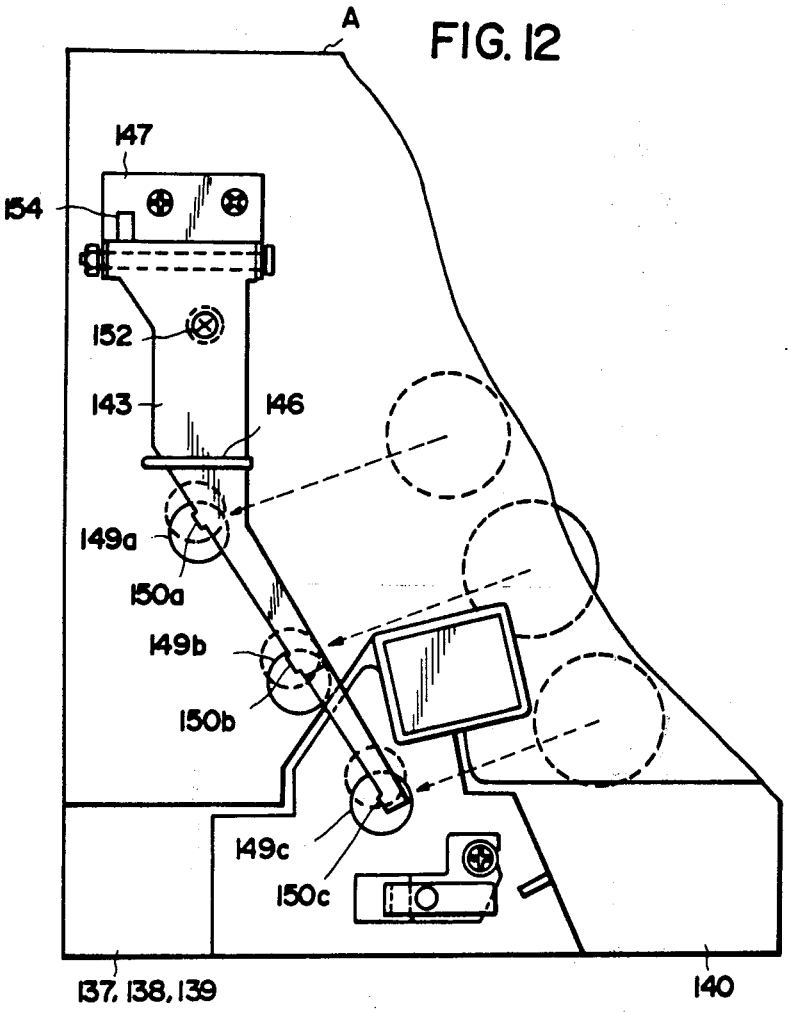
FIG. 12 is a rear view of the coin return device as viewed from the rear side of the acceptor.

Referring to FIGS. 11 and 12, a return lever 143 is pivotably supported at one end thereof on a support 147 which is fixedly secured to the rear surface of the acceptor A. This return lever 143 is provided with interrupting pins 150*a*, 150*b* and 150*c* which are respectively adapted to interrupt the paths $l_3$, $l_1$ and $l_5$ of the acceptor A in the reject position. The acceptor A is formed with apertures 149*a*, 149*b* and 149*c* for respectively receiving the pins 150*a*, 150*b* and 150*c*. An adjusting screw 152 is secured to the rear surface of the acceptor A. This adjusting screw 152 extends through the return lever 143. A helical spring 151 is provided about the adjusting screw 152 between the return lever 143 and the rear surface of the acceptor A.

A return solenoid CA secured to a body 142 of the vending machine has a movable iron piece 145 to which is fixedly attached an actuating lever 146 of the return lever 143. When the movable iron piece 145 is not attracted to the solenoid CA, i.e. the solenoid CA is not energized, the actuating lever 146 urges the return lever 143 by force of a spring 153 to a position wherein the interrupting pins 150*a* – 150*c* can interrupt the passage of the coins. Reference numerals 154 and 148 respectively identify stops provided at the end portions of the lever 143 and the movable iron piece 145.

The operation of the coin return device will now be described.

When vending has to be stopped due to stoppage of electricity or exhaustion of the article to be vended, the solenoid CA is deenergized to release the movable iron piece 145. The movable iron piece 145 is pivoted away from the solenoid CA due to the force of the spring 153 thereby causing the actuating lever 146 to move the return lever 143 to a position wherein the interrupting pins 150*a* – 150*c* extend through the apertures 149*a* – 149*c* of the acceptor A and thereby interrupt the coin paths $l_3$, $l_1$ and $l_5$. Accordingly, the inserted coin is interrupted by either one of the pins 150*a* – 150*c* depending upon the denomination of the coin as shown in FIG. 12, and cannot pass to the outlet 137, 138 or 139 (FIG. 10) but is diverted to the return outlet 140 (FIG. 10).

When the vending operation is started, the solenoid CA is energized to attract the movable iron piece 145. This causes the return lever 143 to pivot in a counterclockwise direction as viewed in FIG. 11 whereby the interrupting pins 150*a* – 150*c* are pulled out of the acceptor A. Thus, the inserted coin can pass to the coin receiving path.

In case the acceptor A is detached from the body 142 of the vending machine and reatached thereto, the adjusting screw 152 provided on the acceptor A is adjusted in accordance with the pressing force of the actuating lever 146.

The above described coin return device is of a very simple construction because the device consists essentially of interrupting pins integrally formed with the return lever and an electromagnet which actuates this return lever. In addition, this device does not produce any vibration while operated because the return lever is driven by the actuating lever provided on the movable iron piece of the electromagnet. Furthermore, the device is advantageous in that the return lever is attached integrally to the acceptor so that no positioning of the interrupting pins is required when the acceptor is attached to the vending machine.

In the acceptor A, construction and operation of parts other than the coin return device are well known and description thereof will be omitted.

Next to be described is the coin control mechanism B.

Figure 13:
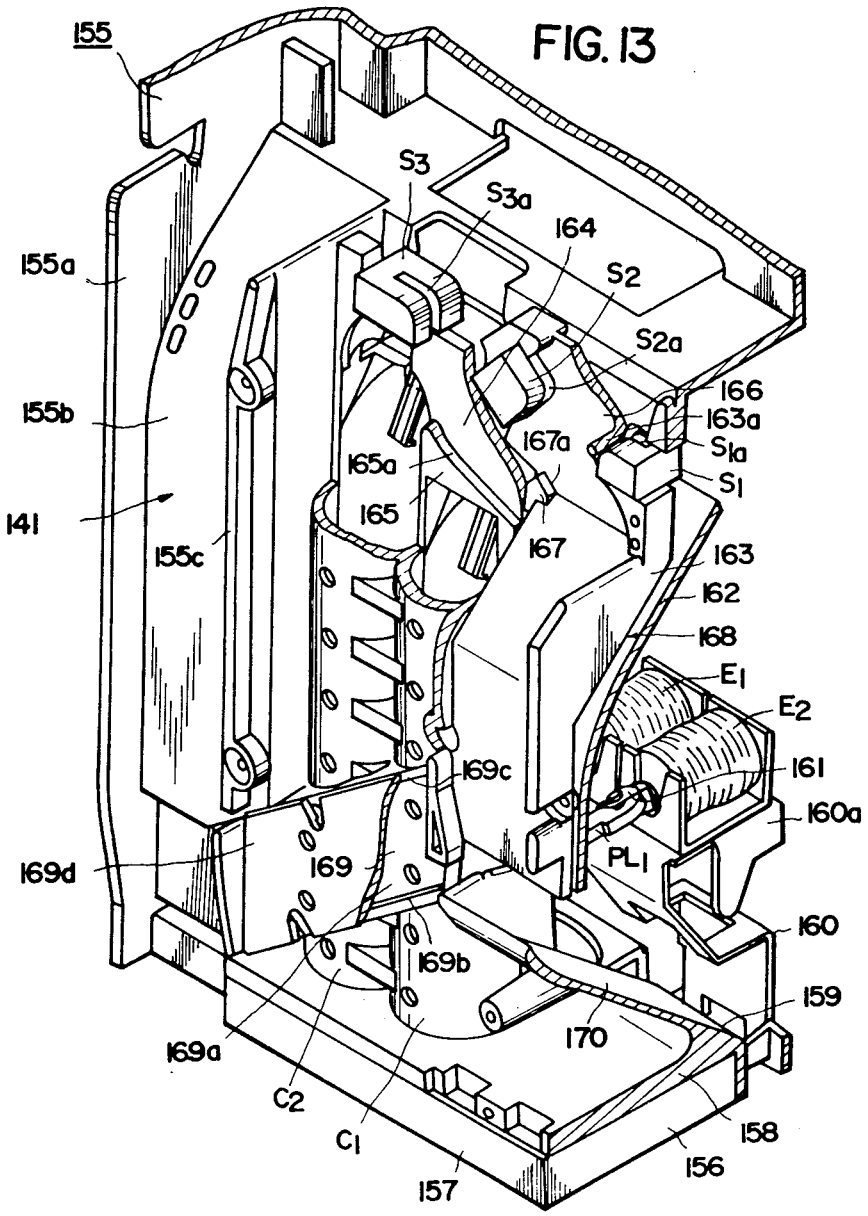
FIG. 13 is a perspective view of the coin control device showing portions thereof in a cut away state.

FIG. 13 is a perspective view of the coin control mechanism B certain portions thereof being broken away and in section to reveal details of construction thereunder. The main return path 141 is formed by side panels 155*a* and 155*c* of a housing 155 and a partly inclined bottom panel 155*b*. A change payout device to be described later is housed in a space defined by lower side panels 156, 157 and a bottom plate 158. The 10 yen coin tube $C_2$ and the 50 yen coin tube $C_1$ are secured at the lower end portion thereof to the bottom plate 158 and extend downwardly through the bottom plate 158. The bottom plate 158 has a inclined plate 170 integrally formed therewith which rises obliquely from its end adjacent an outlet 159. A frame 160 for supporting electromagnetic solenoids $E_1$ and $E_2$ is also fixedly secured to the bottom plate 158. The solenoids $E_1$ and $E_2$ are fixed to a horizontal frame portion 160*a* of the frame 160. A plunger 161 of the solenoid $E_2$ is connected to a receiving lever $PL_1$. When the solenoid is deenergized, the plunger 161 projects to cause the lever $PL_1$ to project through an aperture formed in a 100 yen coin guide panel 162 to a position in which the foremost end portion of the lever $PL_1$ abuts against the inside surface of a 10 yen and 50 yen coin guide panel 163. Although not shown in the figure, the plunger of the solenoid $E_1$ likewise is connected to a return lever $PL_2$ (FIGS. 10 and 14) and the return lever $PL_2$ is in a position in which the foremost end portion thereof abuts against the inside surface of the guide panel 163.

A proximity switch $S_3$ is provided above the receiving end of the 10 yen coin tube $C_2$ for detecting passage of an inserted 10 yen coin. This switch $S_3$ is generally U-shaped with a recess $S_{3a}$ for allowing the 10 yen coin to pass through it. Accordingly, the inserted 10 yen coin drops into the coin tube $C_2$ through the recess $S_{3a}$ of the proximity switch $S_3$ and is stacked in the coin tube $C_2$. A 50 yen coin likewise drops into the coin tube $C_1$ through a recess $S_{2a}$ of a proximity switch $S_2$.

If any one of the coin tubes $C_2$ and $C_1$ is filled with a predetermined number of coins, the inserted coin which has passed through the associated one of the proximity switches $S_3$ and $S_2$ is not received in the coin tube. This operation will be described in detail hereinbelow. Referring to FIGS. 16(*a*) and 16(*b*), a coin blocker $SX_1$ including a pin $P_1$, a weight $W_1$, a block-out lever $BL_1$ and a coin driven lever $K_1$ is provided above the receiving end of the 10 yen coin tube $C_2$. Similarly, a coin blocker $SX_2$ including a pin $P_2$, a weight $W_2$, a block-out lever $BL_2$ and a coin driven lever $K_2$ is provided above the 50 yen coin tube $C_1$.

Figure 15:
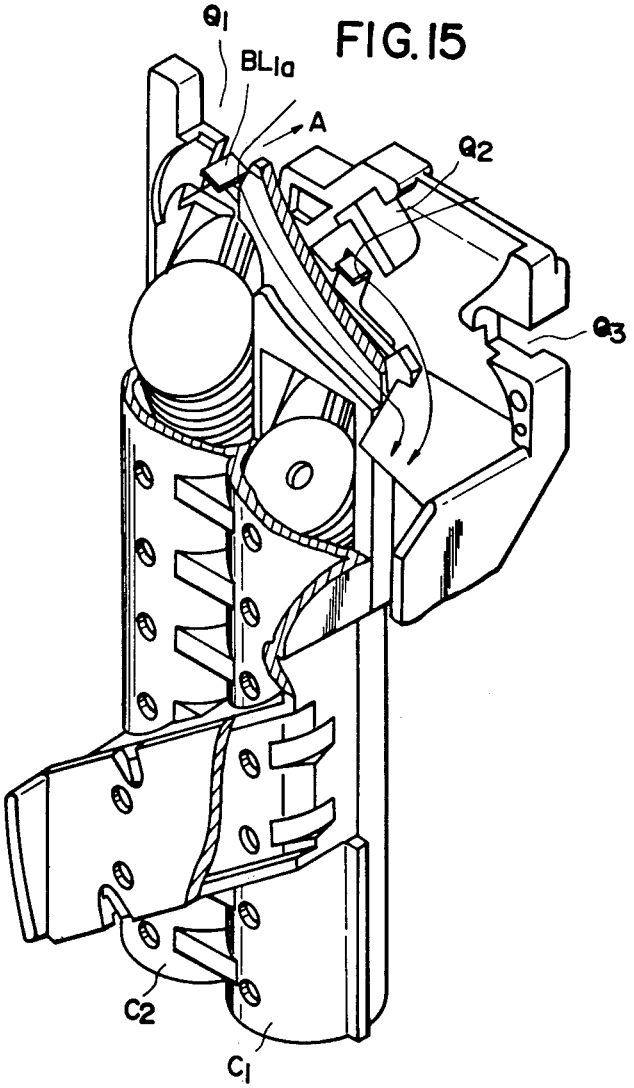
FIG. 15 is a perspective view showing coin paths above 10 yen coin and 50 yen coin tubes.

When there is no stack of coins or the stack of coins is relatively low, the coin inside of the coin tube $C_2$ does not ride on the coin driven lever $K_1$. The blocker $SX_1$ therefore is in a position wherein it is rotated clockwise as viewed in FIG. 16 due to the weight $W_1$ with the foremost end portion of the block-out lever $BL_1$ withdrawn from the path of the 10 yen coin. Accordingly, the 10 yen coin can pass down to the coin tube $C_2$. More specifically, the foremost end portion $BL_{1a}$ of the lever $BL_1$ is withdrawn in a direction of arrow A in FIG. 15. The foremost end portion $BL_{1a}$ is disposed, in its projecting position, beneath the recess $S_{3a}$ of the proximity switch $S_3$. In FIG. 15, reference character $Q_1$ denotes a recess for fitting the proximity switch $S_3$, $Q_2$ that for the proximity switch $S_2$ and $Q_3$ that for the proximity switch $S_1$. As shown in FIG. 16(*a*), a plurality of coins are horizontally stacked in the coin tube $C_2$. Then, as the stack increases its height, several coins are obliquely received in the coin tube $C_2$ with one peripheral end portion thereof being supported by a projection 171 formed on the inner wall of the coin tube $C_2$. The oblique stack of coins increases its height until at last a newly introduced coin holds the lever $K_1$ against the inside wall of the coin tube $C_2$ against the clockwise pivoting force of the weight $W_1$ thereby causing the foremost end portion of the block-out lever $BL_1$ to project into the space beneath the recess $S_{3a}$ of the proximity switch $S_3$ as shown in FIG. 16(*a*) and block the path of the 10 yen coin to the coin tube $C_2$. The coin receiving control for the 50 yen coin is performed in a like manner (FIG. 16 (*b*)).

The coin thus prevented from dropping into the coin tube $C_2$ by the block-out lever $BL_1$ passes obliquely downwardly along the side portion of a guide panel 164 and the upper portion 165*a* of a guide panel 165 as illustrated in FIG. 13 and reaches the guide panel 163. The coin further passes from the guide panel 163 down the inclined panel 170 to the outlet 159 and is received in the cash box (not shown).

The 50 yen coin prevented from dropping into the coin tube $C_1$ by the block-out lever $BL_2$ passes obliquely downwardly along the side portion of a guide panel 166 and between the upper end portion 167a of a guide panel 167 and the projection 163*a* of the guide panel 163 and further along the guide panel 163 to the inclined panel 170. Thus, the 50 yen coin is received in the cash box in the same manner as in the case of the 10 yen coin.

Figure 14:
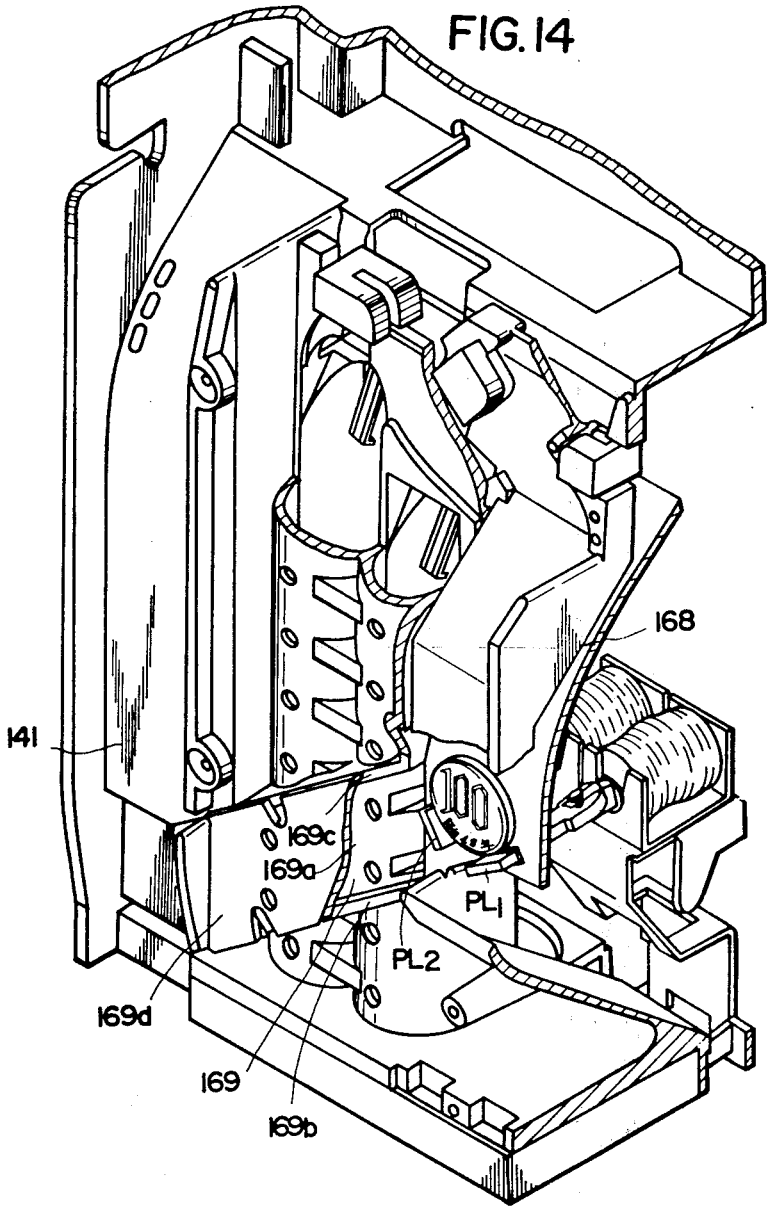
FIG. 14 is a perspective view similar to FIG. 13 showing the coin control device in a state wherein a 100 yen coin is temporarily retained.

The inserted 100 yen coin drops through the recess $S_{1a}$ of the proximity switch $S_1$ and is guided along a path 168 between the guide plates 162 and 163. Since the solenoids $E_1$ and $E_2$ are deenergized at this time, the levers $PL_1$ and $PL_2$ are projecting in the path 168 and, accordingly, the 100 yen coin is temporaily retained by the levers $PL_1$ and $PL_2$. FIG. 14 illustrates a state in which the 100 yen coin is temporarily held by these levers $PL_1$ and $PL_2$. The entrance of a return path 169 is provided adjacent the lever $PL_2$. The return path 169 which is formed by a bottom panel 169*a*, side panels 169*b* and 169*c* and an upper panel 169*d* is disposed obliquely downwardly from the path 168 to the main return path 141.

When the purchaser has stopped purchase of the article and the return solenoid $E_1$ is energized, the lever $PL_2$ is withdrawn and the 100 yen coin passes along the return path 169 and the main return path 141 to the return outlet OUT.

When, on the other hand, the solenoid $E_2$ is energized for the purchase of the article, the lever $PL_1$ is withdrawn and the 100 yen coin passes down the inclined panel 170 to the outlet 159 for storage in the cash box.

Referring to FIGS. 17, 18 and 19, the change payout device will be described. This device is adapted to pay out 10 yen and 50 yen coins as change when the purchase is made and, in case the purchaser has stopped purchase after he inserted 10 yen and/or 50 yen coins, pay out coins of the same denominations.

A 50 yen coin payout slide 172 is pivotably supported on a pin PN secured to a base plate 176 adjacent the lower open end of the 50 yen coin tube $C_1$. A 10 yen coin payout slide 173 also is pivotably supported on the pin PN adjacent the lower open end of the 10 yen coin tube $C_2$. A 10 yen coin bottom plate 174 is interposed between these slides 172 and 173. A 50 yen coin bottom plate 175 is secured to the base plate 176 under the slide 172. The bottom plate 174 is formed with an aperture 174a having a sufficient diameter to allow a 10 yen coin to pass therethrough. Similarly, the bottom plate 175 is formed with an aperture 175*a* having a sufficient diameter to allow a 50 yen coin to pass therethrough. The slide 173 is formed with an aperture $J_1$ capable of allowing a 10 yen coin to pass therethrough and the slide 172 with an aperture $J_2$ capable of allowing a 50 yen coin to pass therethrough.

The slides 173 and 172 are respectively connected at their left end portions (as viewed in FIG. 17) to a 10 yen payout link 177 and a 50 yen payout link 178 by means of pins 184 and 85. The 10 yen payout link 177 consists of a flat portion 177*a* and a T-shaped portion 177b erecting from the flat portion 177*a*. The 50 yen payout link 178 is substantially of the same construction and is disposed beneath the link 177 in parallel spaced relationship therewith. The pin 184 is connected to a fixed pin on the base plate 176 through a spring $G_1$ and the pin 185 to another fixed pin on the base plate 176 through a spring $G_2$.

The 10 yen payout link 177 is formed at one end portion thereof with recesses $H_1$, $H_1$, whereas the 50 yen payout link 178 is formed at one end portion thereof with an aperture 179. These end portions of the links 177 and 178 are inserted in horizontal openings formed in a link lock housing 180. A link lock 181 which is connected to the plunger of the 50 yen–10 yen payout electromagnetic solenoid $E_3$ is inserted in a vertical opening 180*a* of the link lock housing 180. When the solenoid $E_3$ is not energized, the link lock 181 is in its lower position with its lower end portion 181*a* being engaged in the aperture 179 of the 50 yen payout link 178. Accordingly, the horizontal movement of the link 178 is prevented in this position, whereas the 10 yen payout link is free to move through an opening 181*b* of the link lock 181.

A 10 yen payout cam 182 connected to the shaft of a motor (not shown) is disposed in a position wherein it is in abutting engagement with the other end of the 10 yen payout link 177. A 50 yen payout cam 183 of a similar shape and also connected to the shaft of the motor is disposed in a position wherein it is in abutting engagement with the other end of the 50 yen payout link 178. When the cam 182 is in a position shown in FIG. 17, the aperture $J_1$ of the slide 173 is in register with the lower open end of the 10 yen coin tube $C_2$ and one 10 yen coin is received in the aperture $J_1$. As the cam 182 is rotated clockwise by 45°, the link 177 is displaced in the direction of arrow a thereby pivoting the slide 173 in a clockwise direction. This brings the aperture $J_1$ of the slide 173 into register with the opening 174*a* of the bottom plate 174 and the 10 yen coin drops through the opening 174*a* to be paid out as change. As the cam 182 is further rotated clockwise by 45°, the link 177 is displaced in the direction opposite to the arrow a thereby pivoting back the slide 173 to its original position shown in FIG. 17. Thus, one 10 yen coin is paid out at each 180° rotation of the cam 182.

When the solenoid $E_3$ is energized, the link lock 181 is displaced to its upper position in which the lower end portion 181*a* of the link lock 181 is disengaged from the aperture 179 of the 50 yen payout link 178 and the narrow lower portion of the opening 181*b* of the link lock 181 is engaged with the neck portion of the 10 yen payout link 177 defined by the recesses $H_1$, $H_1$. Accordingly, the horizontal displacement of the 10 yen payout link 177 is prevented, whereas the 50 yen payout link is free to move through the opening of the link lock housing 180. Thus, one 50 yen coin is paid out through the opening 175*a* of the bottom plate 175 at each 180° rotation of the cam 183 in the same fashion as has been described above.

It will be understood from the foregoing description that in event a coin of large denomination has been inserted in the slot but the same amount of money as the inserted coin must be returned to the purchaser because of his stopping of purchase notwithstanding the state of shortage or depletion of coins of medium and small denominations in the coin tubes, the inventive device is capable of returning the inserted large denomination coin itself so that the purchaser will never fail to receive the amount of money deposited in the machine.

According to this coin control device, if a coin of small or medium denomination is to be returned after insertion, a coin of the same denomination as the inserted one is returned. Inasmuch as returning of the deposited amount of money is effected by the coin of the same denomination as the inserted one, this device is useful for preventing an undesirable utilization of the vending machine for exchange purposes, i.e. obtaining coins of small denomination by inserting a coin of large denomination.

What is claimed is:

1. A vending machine incorporating an acceptor capable of sorting out coins of at least three different denominations of first, second and third orders in precedence comprising coin paths respectively directing coins of the second and third orders among the coins deposited in and sorted out by the acceptor to positions above their corresponding coin tubes, means for preventing introduction of the coins of the second and third orders to said coin tubes when said coin tubes already contain predetermined number of coins and passing the coins of the second and third orders to said coin tubes when said coin tubes contain coins of less than said predetermined number, a first path directing the blocked coin to a cash box, a second path directing the coin of the first order to the cash box, a third path leading from a predetermined position of said second path to a return outlet, means for temporarily retaining said coin of the first order by projecting first and second levers which are capable of projecting into and withdrawing from said second path at said predetermined position, passing the retained coin to said third path by withdrawing said first lever and to the cash box by withdrawing said second lever, coin payout means for paying out coins required for change or return purpose one by one from said coin tubes containing the coins of the second and third orders, a coin return device provided on the acceptor, said coin return device including a return lever pivotally supported at one end thereof on the acceptor and having interrupting pins provided integrally therewith for interrupting passage of the coins in the coin paths of the acceptor and a return spring, and an actuating lever provided on a movable iron piece of an electromagnet attached to the body of the vending machine and being adapted to push said return lever to a position wherein said interrupting pins interrupt passage of the coins when said electromagnet is in a deenergized state.

* * * * *